US011713650B2

(12) United States Patent
Partridge

(10) Patent No.: US 11,713,650 B2
(45) Date of Patent: Aug. 1, 2023

(54) DIVERTER VALVE

(71) Applicant: FMC Technologies, Inc., Houston, TX (US)

(72) Inventor: Jeffrey Partridge, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 31 days.

(21) Appl. No.: 17/340,879

(22) Filed: Jun. 7, 2021

(65) Prior Publication Data

US 2021/0293114 A1 Sep. 23, 2021

Related U.S. Application Data

(63) Continuation of application No. 16/677,274, filed on Nov. 7, 2019, now Pat. No. 11,041,366.

(51) Int. Cl.
*E21B 34/14* (2006.01)

(52) U.S. Cl.
CPC ..... *E21B 34/14* (2013.01); *E21B 2200/06* (2020.05)

(58) Field of Classification Search
CPC ..... E21B 34/14; E21B 2200/06
See application file for complete search history.

(56) References Cited

U.S. PATENT DOCUMENTS

| | | | | |
|---|---|---|---|---|
| 2,717,646 | A | 9/1955 | Johnston | |
| 10,309,544 | B2 | 6/2019 | Matteucci et al. | |
| 2011/0240311 | A1 | 10/2011 | Robison et al. | |
| 2013/0014947 | A1 * | 1/2013 | Wilkins | E21B 33/068 166/281 |
| 2019/0136663 | A1 * | 5/2019 | Roessler | E21B 34/063 |

OTHER PUBLICATIONS

Office Action issued in Canadian Application No. 3,098,050, dated Jan. 20, 2022 (7 pages).

* cited by examiner

*Primary Examiner* — Dany E Akakpo
(74) *Attorney, Agent, or Firm* — Osha Bergman Watanabe & Burton LLP

(57) ABSTRACT

One illustrative diverter valve disclosed herein includes a body with a primary flow path therethrough, first and second fluid flow galleries, first and second fluid outlets, a first sliding sleeve element and a second sliding sleeve element. The first and second sliding sleeve elements, respectively, include first and second internal flow bores, respectively, wherein each of the first and second sliding sleeve elements are adapted to be moved from a first closed position to a second open position, and vice-versa. In the first and second positions, respectively, the first sliding sleeve element blocks or does not block, respectively, fluid flow between the first internal flow bore and the first fluid flow gallery. In the first and second positions, respectively, the second sliding sleeve element blocks or does not block, respectively, fluid flow between the second internal flow bore and the second fluid flow gallery.

9 Claims, 18 Drawing Sheets

DIVERTER VALVE

BACKGROUND

1. Field of the Disclosure

The present disclosure is generally directed to various novel embodiments of a diverter valve that may be employed in various systems and applications.

2. Description of the Related Art

Recent years have seen many wells drilled and produced using well-known fracking techniques. Fracturing techniques typically involve forming a plurality of perforations through a cemented casing positioned in a wellbore. The initial perforations extend into the formation for at least some distance. At that point, a relatively large quantity of a high-pressure fracturing ("frac") fluid (typically a combination of water, chemical additives and proppants (e.g., sand, ceramics, etc.)) is pumped into the wellbore. The high pressure of the frac fluid and the continual pumping of the frac fluid increases the pressure within the well until such time as the pressure within the well is sufficient (e.g., 10,000 psi or greater) to overcome the fracture strength of the surrounding formation, thereby forming cracks that extend outward from the well and into the formation. The pumping of the high-pressure frac fluid is continued so as to cause the initial cracks in the formation to extend a desired distance into the formation. Once the final cracks or final fractures of the desired length are formed in the formation, the pumping will be stopped and the pressure within the well and the cracks is greatly reduced. However, the proppants that were pumped into the factures under high pressure will prevent the fractures from completely closing once the pumping of frac fluid at high pressure is stopped, i.e., the proppants will act to hold the final fractures open. At that point, the frac fluid is removed from the wellbore and hydrocarbon-containing fluids, e.g., oil and gas, are allowed to flow from the formation and into the wellbore through the propped-open fractures.

Some existing fracturing systems include, among other things, numerous valves, an extensive network of pipes, a number of trucks that contain high-pressure pumping equipment, a blender, and a frac manifold. The high-pressure pumping equipment is operatively coupled to the frac manifold so as to increase the pressure of the frac fluid as it is pumped into the well and ultimately out into the cracks formed in the formation. A function of a typical frac manifold is to receive pressurized fluid from the pumping equipment and to divide the pressurized fluid into manifold legs, with each leg being devoted to one wellbore and containing two gate valves to isolate that wellbore from the flow of pressurized frac fluid. In a modern frac environment, in which there may be four or more wells connected to a single frac manifold, a plurality of gate valves are typically used for purposes of directing the high pressure frac fluid to a particular well while isolating other wells from the high pressure frac fluid. Unfortunately, such gate valves contribute considerably to the overall weight and size of the manifold, as well as the overall cost of a particular fracturing job. Moreover, there are limitations with respect to how the gate valves can be arranged to isolate one or more of the wellbores.

The present disclosure is therefore directed to various novel embodiments of a diverter valve that may be employed in various systems and applications.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present disclosure is generally directed to various embodiments of a diverter valve. One illustrative diverter valve disclosed herein includes a body with a primary flow path therethrough, first and second fluid flow galleries in the body and first and second fluid outlets in dedicated fluid communication with the first and second fluid flow galleries, respectively. In this illustrative embodiment, the valve also includes a first sliding sleeve element and a second sliding sleeve element. The first sliding sleeve includes a first internal flow bore that is in fluid communication with the primary flow path, wherein the first sliding sleeve element is adapted to be moved from a first closed position to a second open position, and vice-versa, wherein, in the first closed position, the first sliding sleeve element blocks fluid flow between the first internal flow bore and the first fluid flow gallery and wherein, in the second open position, the first sliding sleeve element does not block fluid flow between the first internal flow bore and the first fluid flow gallery. The second sliding sleeve element includes a second internal flow bore that is in fluid communication with the primary flow path, wherein the second sliding sleeve element is adapted to be moved from a first closed position to a second open position, and vice-versa, wherein, in the first closed position, the second sliding sleeve element blocks fluid flow between the second internal flow bore and the second fluid flow gallery and wherein, in the second open position, the second sliding sleeve element does not block fluid flow between the second internal flow bore and the second fluid flow gallery.

BRIEF DESCRIPTION OF THE DRAWINGS

The disclosure may be understood by reference to the following description taken in conjunction with the accompanying drawings, in which like reference numerals identify like elements, and in which.

Figure 1:
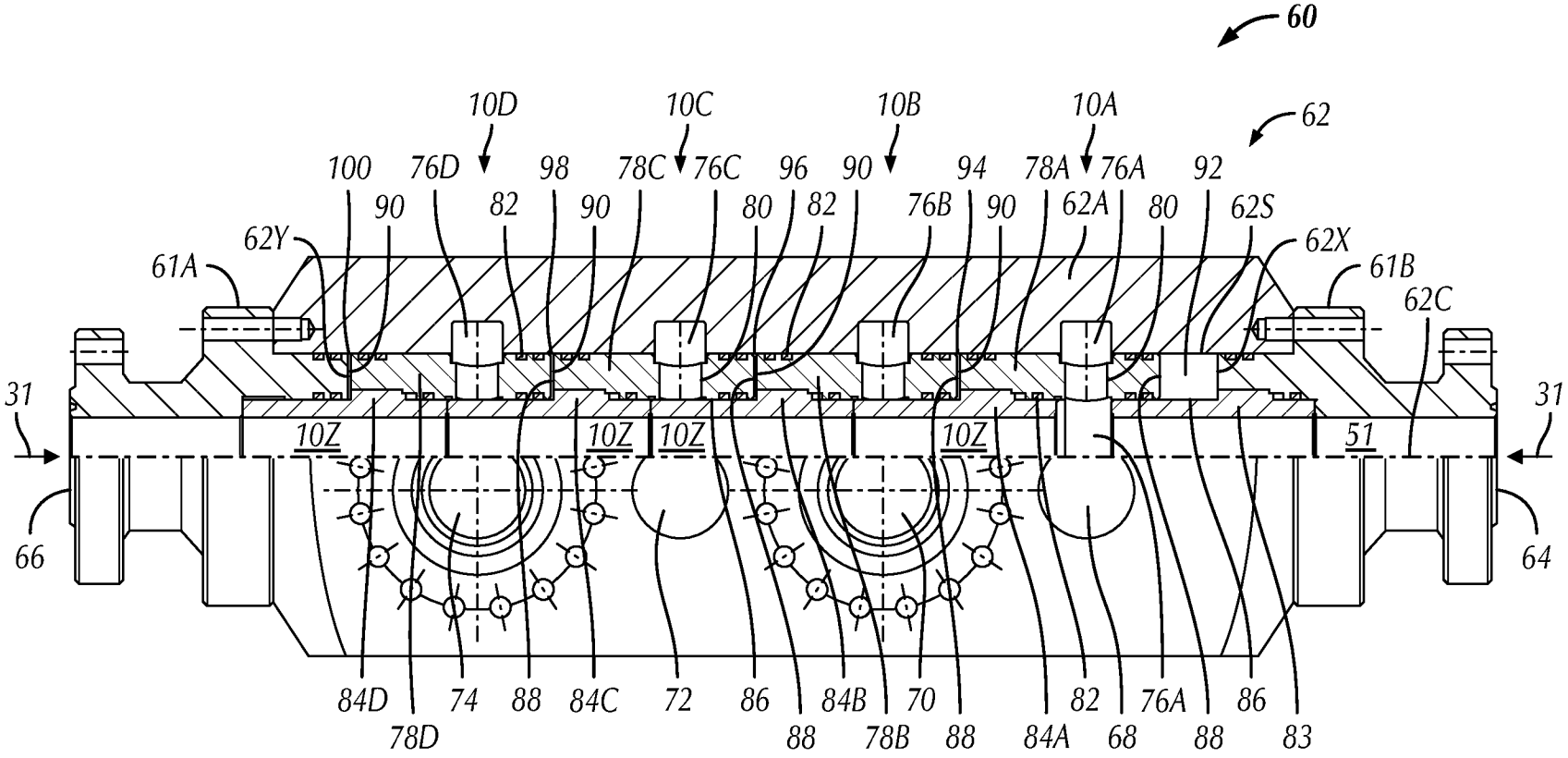
FIGS. 1-9 are various views of one illustrative embodiment of a diverter valve disclosed herein.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments of the invention may be practiced without some or all of such various disclosed details. Furthermore, features and/or processes that are well known in the art may not be described in full detail so as not to unnecessarily obscure the disclosure of the present subject matter. In addition, like or identical reference numerals may be used to identify common or similar elements.

Figure 2:
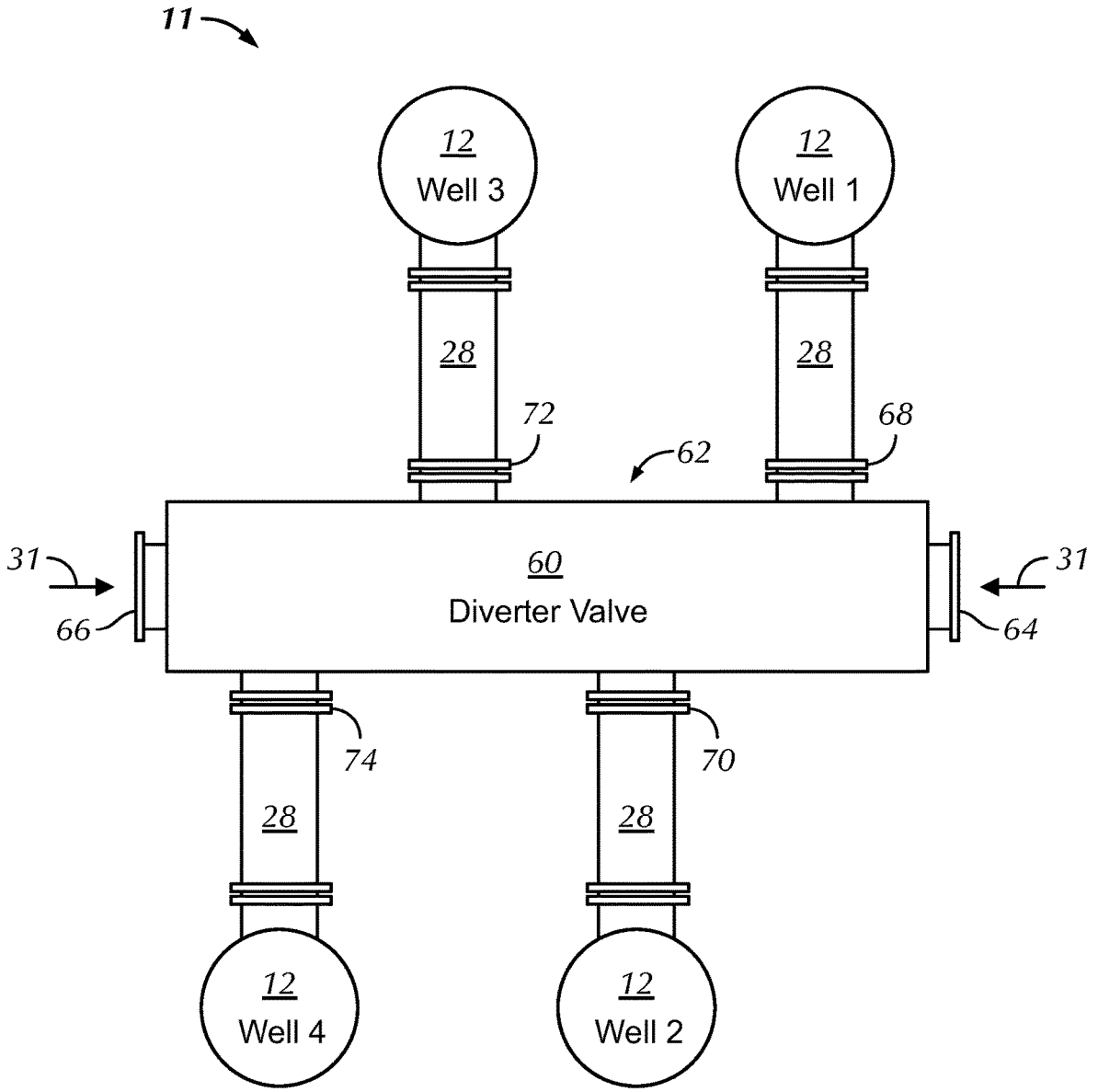

FIGS. 1-9 are various views of one illustrative embodiment of a diverter valve 60 disclosed herein. FIG. 1 is a partial cross-sectional side view of the diverter valve 60. FIG. 2 is a simplistic plan view of an illustrative fracturing system 11 wherein the illustrative diverter valve 60 may be employed as part of a system for use in fracturing a plurality of oil and gas wells 12. In general, this illustrative diverter valve 60 is capable of selectively diverting fracturing fluid 31 to one of four illustrative wells (1-4). However, after a complete reading of the present application, those skilled in the art will appreciate that the diverter valve 60 may be designed to accommodate and function with any desired number of wells, e.g., two wells, five wells, eight wells, etc. In some applications, the diverter valve 60 may be designed to accommodate four wells, but the valve 60 may be employed in a fracturing operation that only involves three wells. In that latter situation, one of the outlets of the diverter valve 60 may simply be blinded off.

Figure 3:
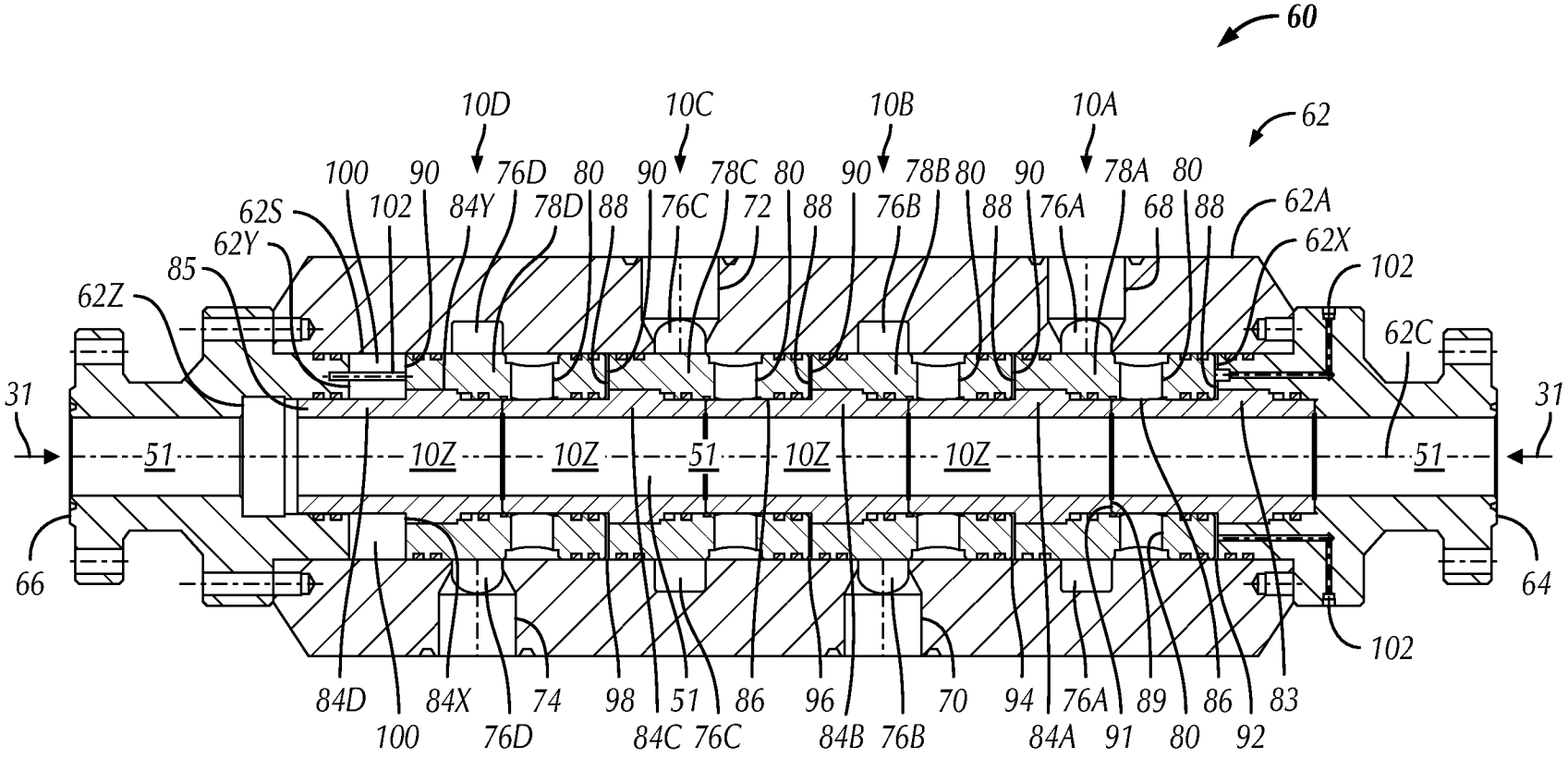
Figure 4:
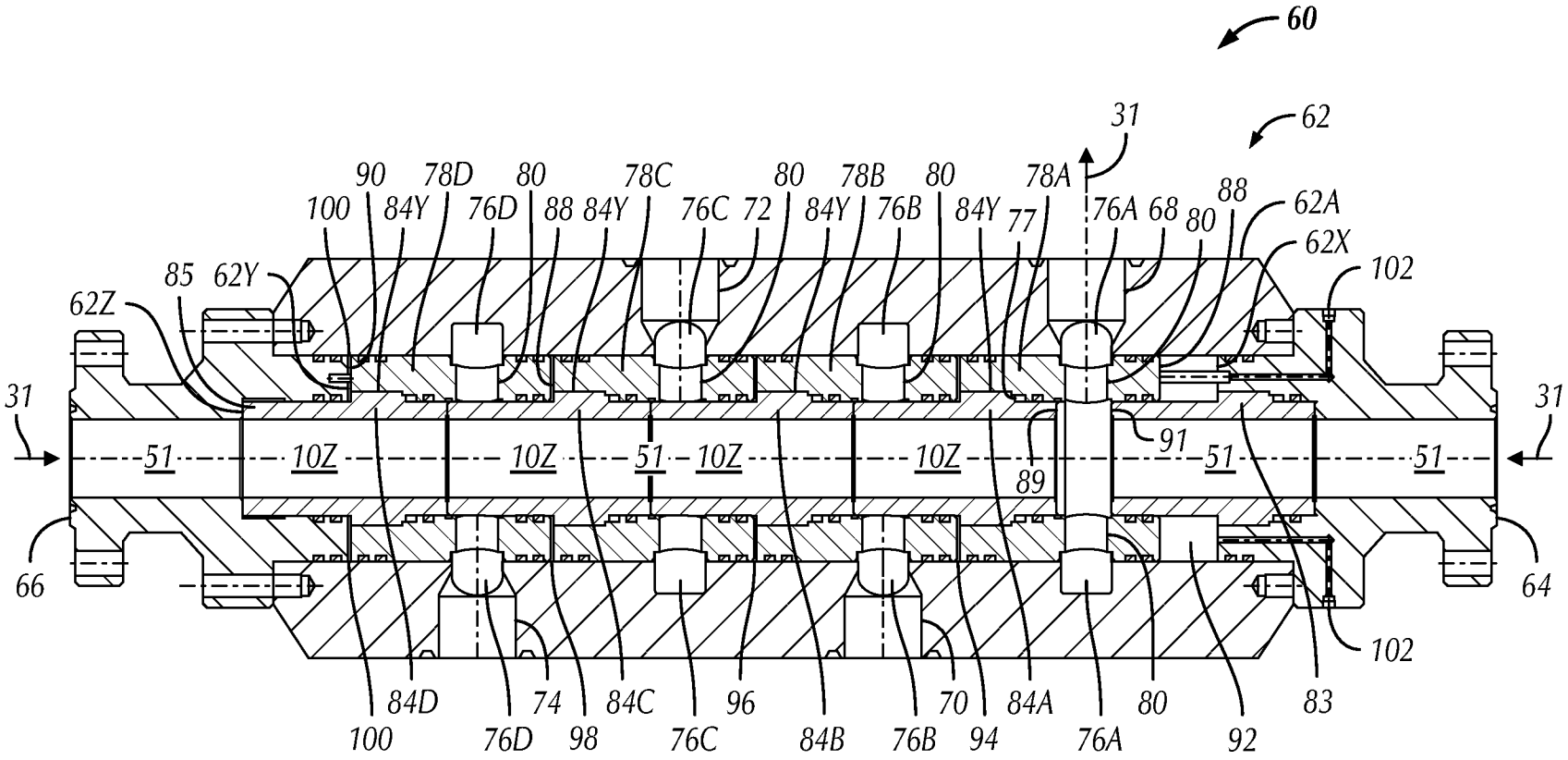
Figure 5:
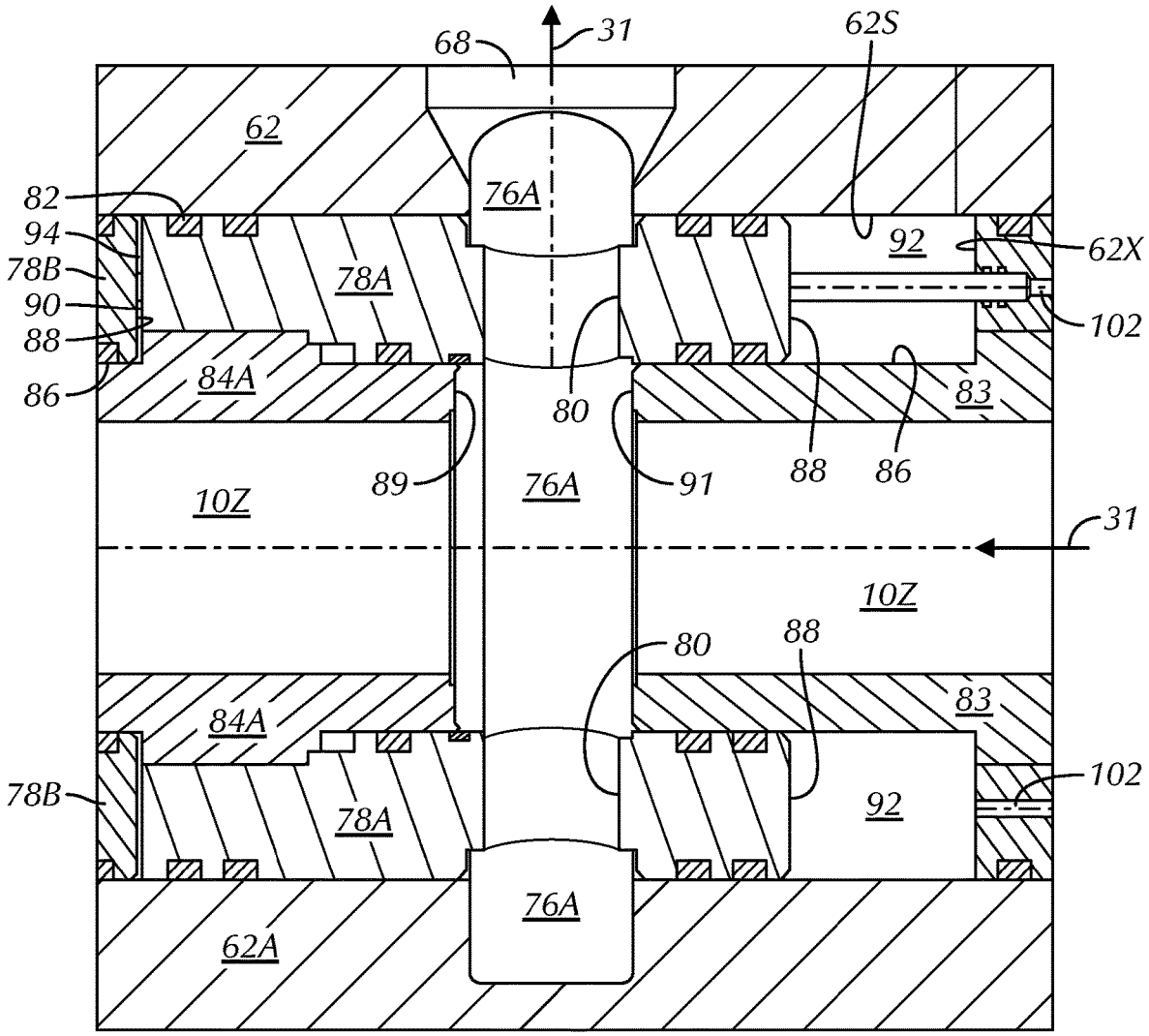

FIGS. 3, 4, 6, 7 and 9 are cross-sectional views of the valve 60 (when viewed from above) that depict illustrative operational states or positions of the diverter valve 60. In general, the diverter valve 60 comprises a plurality of sliding sleeve valves 10A-D (collectively referenced using the numeral 10), the structure and operation of which will be described more fully below. FIGS. 5 and 8 are enlarged cross-sectional views of portions of the sliding sleeve valves 10 when the diverter valve 60 is in various operational states, as described more fully below.

In this example, the diverter valve 60 comprises a body 62 with a longitudinal centerline 62C and an inner surface 62S (see, e.g., FIGS. 1 and 3). In the depicted example, the body 62 comprises a main body portion 62A and first and second flanged structures 61A, 61B that are operatively coupled to the main body 62A by threaded fasteners. In this example, the main body portion 62A is a one-piece body. However, in other applications, the main body portion 62A may comprise a plurality of separate bodies that are operatively coupled to one another using a variety of known techniques, e.g., flanged connections. Thus, the subject matter disclosed herein should not be considered to be limited to the illustrative one-piece main body portion 62A depicted herein. Moreover, in some applications, the first and second flanged structures 61A, 61B may be formed integral with the main body portion 62A. Thus, the presently disclosed subject matter should not be considered to be limited to applications where the first and second flanged structures 61A, 61B are removably coupled to the main body portion 62A In this particular example, four illustrative sliding sleeve valves 10A-D are positioned in series in the diverter valve 60. The diverter valve 60 also includes a first fluid flow port 64 and a second fluid flow port 66 that are in fluid communication with a primary fluid flow path 51 through the body of the diverter valve 60. In the illustrative example of the diverter valve 60 depicted in FIGS. 1-9, both of the fluid flow ports 64 and 66 are fluid inlets that allow fracturing fluid 31 to flow into the primary fluid flow path 51 of the diverter valve 60. With reference to FIG. 3, each of the sliding sleeve valves 10 has an internal flow bore 10Z. In the depicted example, the internal flow bore 10Z in each of the valves 10 is substantially coaxial with the primary fluid flow path 51 through the overall diverter valve 60. In other embodiments, one of the flow ports, e.g., the flow port 64, may function as a fluid inlet that allows fluid 31 to enter the diverter valve 60, while the other fluid flow port, e.g., the flow port 66, functions as a fluid outlet that allows fluid 31 to exit the diverter valve 60 and flow to a piece of equipment that is positioned downstream of the diverter valve 60, e.g., another diverter valve 60, a gate valve, a check valve, etc. In some applications, fluid 31 that exits the diverter valve 60 may flow to a well. In the depicted example, the fluid flow ports 64, 66 take the form of flanged piping components that are operatively coupled to the body 62. Of course, if desired, the fluid flow ports 64, 66 may be formed integral with the body 62 or they may be coupled to the body 62 by other means, e.g., via threaded or clamped connections.

The diverter valve 60 also comprises a plurality of dedicated fluid outlets for selectively directing fracturing fluid 31 to one of four oil/gas wells: the fluid outlet 68 (for well 1), the fluid outlet 70 (for well 2), the fluid outlet 72 (for well 3) and the fluid outlet 74 (for well 4). With reference to FIG. 1, the fluid outlet 68 (for well 1) and the fluid outlet 72 (for well 3) are positioned on the opposite side of the body 62 of the diverter valve 60. As shown in FIG. 2, the fluid outlets 68, 70, 72 and 74 in the diverter valve 60 are depicted as terminating in a flanged connection that is adapted to be operatively coupled to some form of fluid flow conduit 28, e.g., piping, flexible hose, that is in fluid communication with the corresponding well.

With reference to FIG. 3, the diverter valve 60 also comprises a plurality of fluid flow galleries 76A-D (collectively referenced using the numeral 76) that are, in this example, formed in the body 62 of the diverter valve 60. The fluid outlets 68, 70, 72 and 74, respectively, are in dedicated fluid communication with the fluid flow galleries 76A, 76B, 76C and 76D, respectively. In one illustrative example, when viewed from an end of the of diverter valve 60, the fluid flow gallery 76 may have a substantially annular configuration.

The diverter valve 60 also comprises a plurality of perforated pistons 78A-78D (collectively referenced using the numeral 78) that are adapted to be shifted axially within the body 62 (i.e., in a direction parallel to the longitudinal centerline 62C) by application of, for example, hydraulic pressure, as described more fully below. Each of the perforated pistons 78 comprise at least one opening 80, a first end surface 88 and a second end surface 90. In the drawings, the first end surface 88 is the right end surface of the piston 78 and the second end surface 90 is the left end of the piston 78. The number, size, shape and position of the openings 80 may vary depending upon the particular application. As will be appreciated by those skilled in the art after a complete reading of the present application, each of the pistons 78 is adapted to be moved axially within the diverter valve 60 from a first piston position to a second piston position and vice-versa. When the piston 78 is in the first piston position, the opening 80 in the piston 78 is not aligned with its corresponding fluid flow gallery 76, i.e., there is no overlap between the opening 80 and its associated fluid flow gallery 76. FIG. 3 depicts the situation wherein all of the pistons 78A-D are in the first piston position. When the piston 78 is in the second piston position, the opening 80 in the piston 78 is at least partially aligned with, and preferably fully aligned with, its corresponding fluid flow gallery 76. FIG. 4 depicts the situation wherein all of the pistons 78A-D are in the second piston position and the opening 80 in each of the pistons 78A-D is substantially fully aligned with it corresponding fluid flow gallery 76. In the illustrative example of the diverter valve 60 depicted herein, the first end surface 88 of a piston 78 does not contact the second surface 90 of an adjacent piston 78 as the pistons 78 are moved axially within the body 62 of the diverter valve 60. However, in other embodiments, the diverter valve 60 may be designed and configured such that the first end surface 88 of a piston 78 abuts and engages the second surface 90 of an adjacent piston 78 as the pistons 78 are moved axially within the body 62 of the diverter valve 60.

The illustrative embodiment of the diverter valve 60 depicted in FIGS. 1-9 also includes a stationary sleeve 83 and a plurality of sliding sleeve elements. In the example depicted in FIGS. 1-9, the plurality of sliding sleeve elements takes the form of a plurality of sliding sleeves 84A-D (collectively referenced using the numeral 84). In the illustrative embodiment of the diverter valve 60 depicted herein, each piston 78 is mechanically coupled to one of the sliding sleeves 84 via a threaded connection 84Y (see FIG. 3). More specifically, the pistons 78A-D are threadingly coupled to the sliding sleeves 84A-D, respectively. As a result, the combination of a sliding sleeve 84 and its associated piston 78 are adapted to be shifted as a single unit axially within the body 62 by application of, for example, hydraulic pressure, as described more fully below. With reference to FIG. 3, each of the sleeves 83, 84 comprise an outer surface 86. As will be appreciated by those skilled in the art after a complete reading of the present application, the sliding sleeves 84 are adapted to be moved axially within the diverter valve 60 from a first closed position to a second open position, and vice-versa. In the first closed position, the sliding sleeve 84 blocks fluid flow between the primary fluid flow path 51 (and the internal flow bore 10X of the valve 10) and its associated fluid flow gallery 76. In the second open position, the sliding sleeve 84 does not block fluid flow between the primary fluid flow path 51 (and the internal flow bore 10Z of the valve 10) and its associated first fluid flow gallery 76. In this example, when in the second closed position, the sliding sleeves 84 constitute a single pressure barrier between the primary fluid flow path 51 of the diverter valve 60 and its corresponding fluid flow gallery 76. As depicted, at least a portion of a piston, e.g., the piston 78B, is positioned radially between at least a portion of a sliding sleeve 84, e.g., the sliding sleeve 84B, and the internal surface 62S of the body 62 of the diverter valve 60.

When the sliding sleeve 84 is in the first open position, and when the piston 78 is in the second piston position, i.e., where the opening 80 in the piston 78 is at least partially aligned with its corresponding fluid flow gallery 76, fracturing fluid 31 flowing within the primary fluid flow path 51 (and the internal flow bore 10Z) of that particular sliding sleeve valve 10 may be selectively supplied to its corresponding well 12 via dedicated flow conduits 28 that are operatively coupled to the individual outlets in the diverter valve 60. That is, fluid 31 flowing within the primary fluid flow path 51 flows through the opening 80 in the piston 78, into and around the flow gallery 76 and out of the dedicated outlet (e.g., 68, 70, 72 or 74 depending upon which valve 10 is open) to the desired well.

As depicted in the drawings, a plurality of illustrative seals 82 is positioned at various locations between and among the various components of the diverter valve 60. The seals 82 are representative in nature and may be of any desired type, size or configuration and they may be comprised of any material suitable for the particular application.

The diverter valve 60 also includes a plurality of hydraulic chambers 92, 94, 96. 98 and 100 that, when supplied with pressurized hydraulic fluid, move various components of the diverter valve 60, e.g., the sliding sleeves 84 and the pistons 78, into an operational position whereby fracturing fluid 31 may be selectively directed to one of the wells 12 or to an operational position whereby the flow of fracturing fluid 31 to all of the wells 12 is prevented. More specifically, supplying hydraulic pressure to the hydraulic chamber 92, 94, 96 and 98 will allow fracturing fluid 31 to be selectively directed to wells 1, 2, 3 and 4, respectively, via the fluid outlet 68, 70, 72 and 74, respectively. Supplying hydraulic pressure to the hydraulic chamber 100 will block the flow of fracturing fluid 31 to all of the wells 12. Of course, as will be appreciated by those skilled in the art after a complete reading of the present application, the movement of the sliding sleeves 84 and pistons 78 may be accomplished by means other than hydraulic pressure. For example, the sliding sleeves 84 and/or the pistons 78 could be configured such that they are adapted for movement by mechanical actuation using a variety of various known mechanical means.

With reference to FIG. 1, the hydraulic chamber 92 is approximately defined by the first end surface 88 of the piston 78A, an interior surface 62X of the body 62, the outer surface 86 of the stationary sleeve 83 and the inner surface 62S of the body 62. FIG. 1 depicts the diverter valve 60 when hydraulic pressure has been applied to the hydraulic chamber 92. This is the "Well 1 Flow" position of the diverter valve 60. FIGS. 4 and 5 also depict the diverter valve 60 in the Well 1 Flow position. Additionally, in the Well 1 Flow position, i.e., with the hydraulic chamber 92 pressurized, all of the pistons 78 are moved to their left-most position within the body of the diverter valve 60, and all of the pistons 78 are in the second piston position wherein the opening 80 in the piston 78 is aligned and in fluid communication with its corresponding flow gallery 76. In the Well 1 Flow position, fracturing fluid 31 flows out of the fluid outlet 68 to well 1, while the flow of fracturing fluid 31 to all of the other wells 2-4 is blocked.

The hydraulic chamber 94 (shown in a non-pressurized state in FIG. 1) is approximately defined by the second end surface 90 of the piston 78A, the first end surface 88 of the piston 78B, the outer surface 86 of the sliding sleeve 84A and the inner surface 62S of the body 62. The hydraulic chamber 96 (shown in a non-pressurized state in FIG. 1) is approximately defined by the second end surface 90 of the piston 78B, the first end surface 88 of the piston 78C, the outer surface 86 of the sliding sleeve 84B and the inner surface 62S of the body 62. The hydraulic chamber 98 (shown in a non-pressurized state in FIG. 1) is approximately defined by the second end surface 90 of the piston 78C, the first end surface 88 of the piston 78D, the outer surface 86 of the sliding sleeve 84C and the inner surface 62S of the body 62. The hydraulic chamber 100 (shown in a non-pressurized state in FIG. 1) is approximately defined by the second end surface 90 of the piston 78D, an interior surface 62Y of the body 62, the outer surface 86 of the sliding sleeve 84D and the inner surface 62S of the body 62.

Hydraulic pressure may be applied to the hydraulic chambers 92, 94, 96, 98 and 100 by traditional hydraulic ports, conduits, valves and systems that are known to those skilled in the art and thus will not be depicted or described in any great detail so as not to obscure the various novel devices and methods disclosed herein. The hydraulic ports and conduits may be of any desired shape, form or configuration as long as they provide a fluid communication path with the hydraulic chambers 92, 94, 96, 98 and 100. The hydraulic ports may be ports that extend radially through the body 62 of the diverter valve 60 or they may be ports or conduits that extend in a direction that is substantially parallel to the longitudinal centerline 62C of the body 62, or they may be combinations of such configurations. In one embodiment, some or all of the hydraulic ports may extend axially through the one or more of the pistons 78. In other embodiments, some or all of the hydraulic ports may extend axially through the one or more of the sliding sleeves 84 and the stationary sleeve 83. The reference numerals 102 and 103 may be used herein to generically reference illustrative examples of such hydraulic ports and flow paths that establish fluid communication with the hydraulic chambers 92, 94, 96, 98 and 100 as well as other hydraulic chambers described below.

FIG. 3 depicts the diverter valve 60 when hydraulic pressure is applied to the hydraulic chamber 100. This is the "Fully Closed" position of the diverter valve 60. In the Fully Closed position, the fracturing fluid 31 that enters the primary fluid flow path 51 of the diverter valve 60 via one or both of the fluid flow ports 64, 66 is blocked from flowing to any of the four wells. The pressurized fluid in the chamber 100 acts on the annular surface 84X of the sliding sleeve 84D and the second end surface 90 of its associated piston 78D to drive all of the sliding sleeves 84 and their associated pistons 78 to their most rightward position within the diverter valve 60, wherein all of the sleeves (83, 84) sealingly abut the adjacent sleeve(s). More specifically, an end surface 89 on the sliding sleeve 84A abuts and sealingly engages an end surface 91 on the stationary sleeve 83. Similarly, an end surface on the sliding sleeve 84B abuts and sealingly engages an end surface on the sliding sleeve 84A, an end surface on the sliding sleeve 84C abuts and sealingly engages an end surface on the sliding sleeve 84B and an end surface on the sliding sleeve 84D abuts and sealingly engages the sliding sleeve 84C. Note that, in the position shown in FIG. 3, the end surface 85 of the sliding sleeve 84D is spaced apart from the surface 62Z of the body 62. However, when the sliding sleeve 84D is in its left-most position within the diverter valve 60, the end surface 85 on the sliding sleeve 84D abuts (and in some embodiments may sealingly engage) the surface 62Z in the body 62 (see, e.g., FIG. 1). When the pistons 78 are in their most rightward position within the diverter valve 60, i.e., the first piston position, the opening 80 in each of the pistons 78 is non-aligned with its corresponding fluid flow gallery 76.

To move from the Fully Closed position shown in FIG. 3, to the Well 1 Flow position shown in FIGS. 1, 4 and 5, pressure is increased in the hydraulic chamber 92 while hydraulic fluid within the hydraulic chamber 100 is allowed to bleed off. Hydraulic pressure within the chamber 92 acts on the first end surface 88 of the piston 78A to shift all of the pistons 78 and their associated sliding sleeve 84 to their left-most position within the diverter valve 60. In this left-most position, all of the pistons 78 are in the second piston position wherein the opening(s) 80 in each of the pistons 78 is substantially aligned with its corresponding fluid flow gallery 76, e.g., the opening 80 in the piston 78A is aligned with the flow gallery 76A.

FIG. 4 reflects a first pair of engaged shoulders 77 on the pistons 78 and on the sliding sleeves 84 that, in combination with the threaded connection 84Y, transfers the actuating forces between the sliding sleeves and the pistons 78 so as to facilitate movement of each of the sliding sleeve 84/piston 78 combinations within the body of the diverter valve 60. With reference to the sliding sleeve 84A by way of example, the pair of engaged shoulders 77 comprise an internal shoulder on its associated piston 78A and an external shoulder on the sliding sleeve 84A.

Note that in the Well 1 Flow position, the end surface 85 of the sliding sleeve 84D abuts and engages the internal surface 62Z in the body 62. In the Well 1 Flow position shown in FIG. 4, the position of the sliding sleeves 84A, 84B and 84C, respectively, prevent fluid 31 from flowing from the primary fluid flow path 51 to the opening(s) 80 in the pistons 78B, 78C and 78D, respectively and to the fluid flow galleries 76B, 76C and 76D, respectively. However, supplying hydraulic pressure to the chamber 92 causes leftward movement of the combination of the piston 78A and its associated sliding sleeve 84A to shift from its previously engaged position with the stationary sleeve 83 (see FIG. 3) to the position shown in FIG. 4. Note the separation between the end surface 89 of the sliding sleeve 84A and the end surface 91 of the stationary sleeve 83. In this Well 1 Flow position, fracturing fluid 31 within the primary fluid flow path 51 is now free to flow through the opening(s) 80 in the piston 78A, into the fluid flow gallery 76A and out of the dedicated fluid outlet 68 to well 1.

Figure 7:
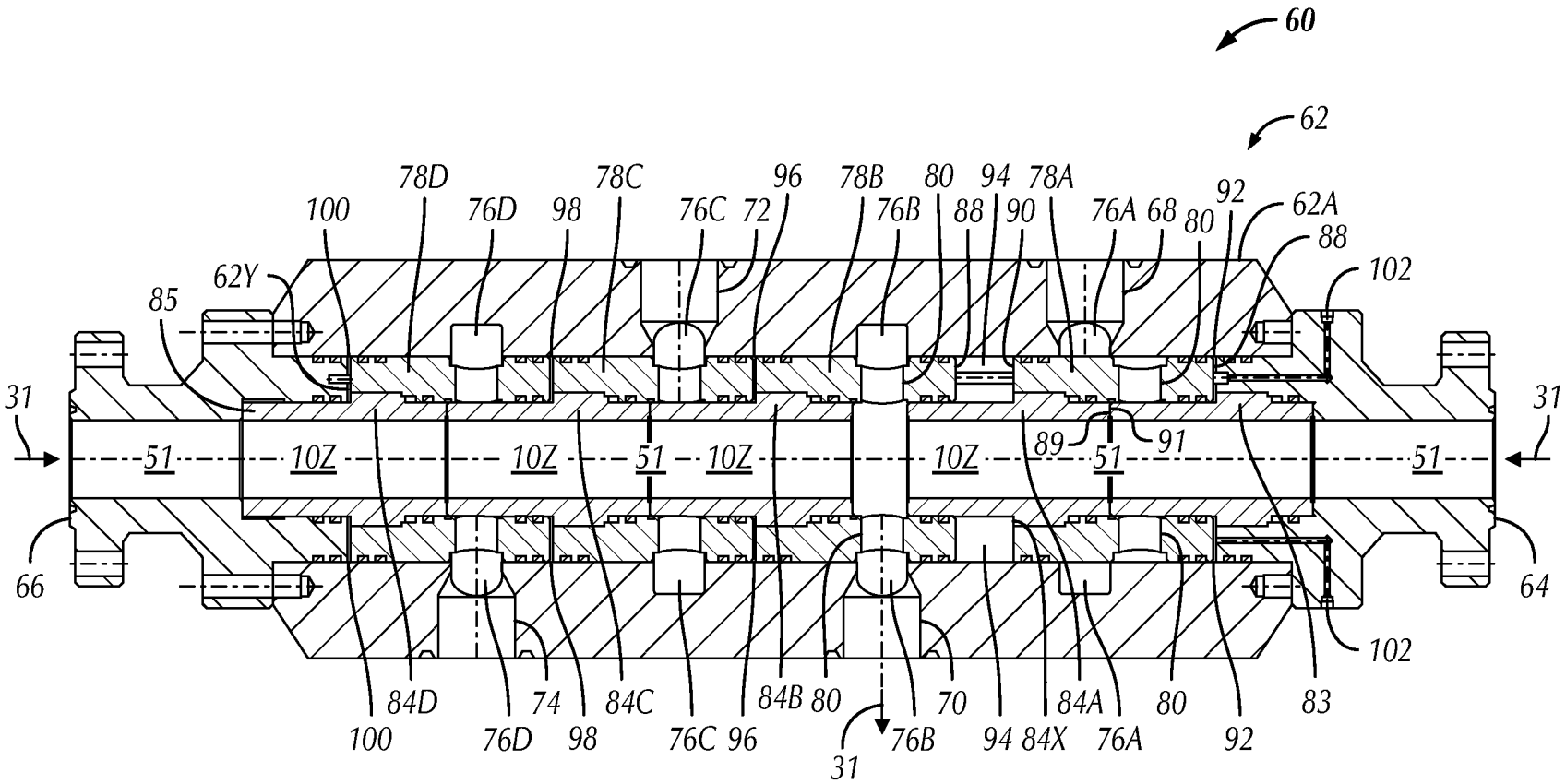
Figure 8:
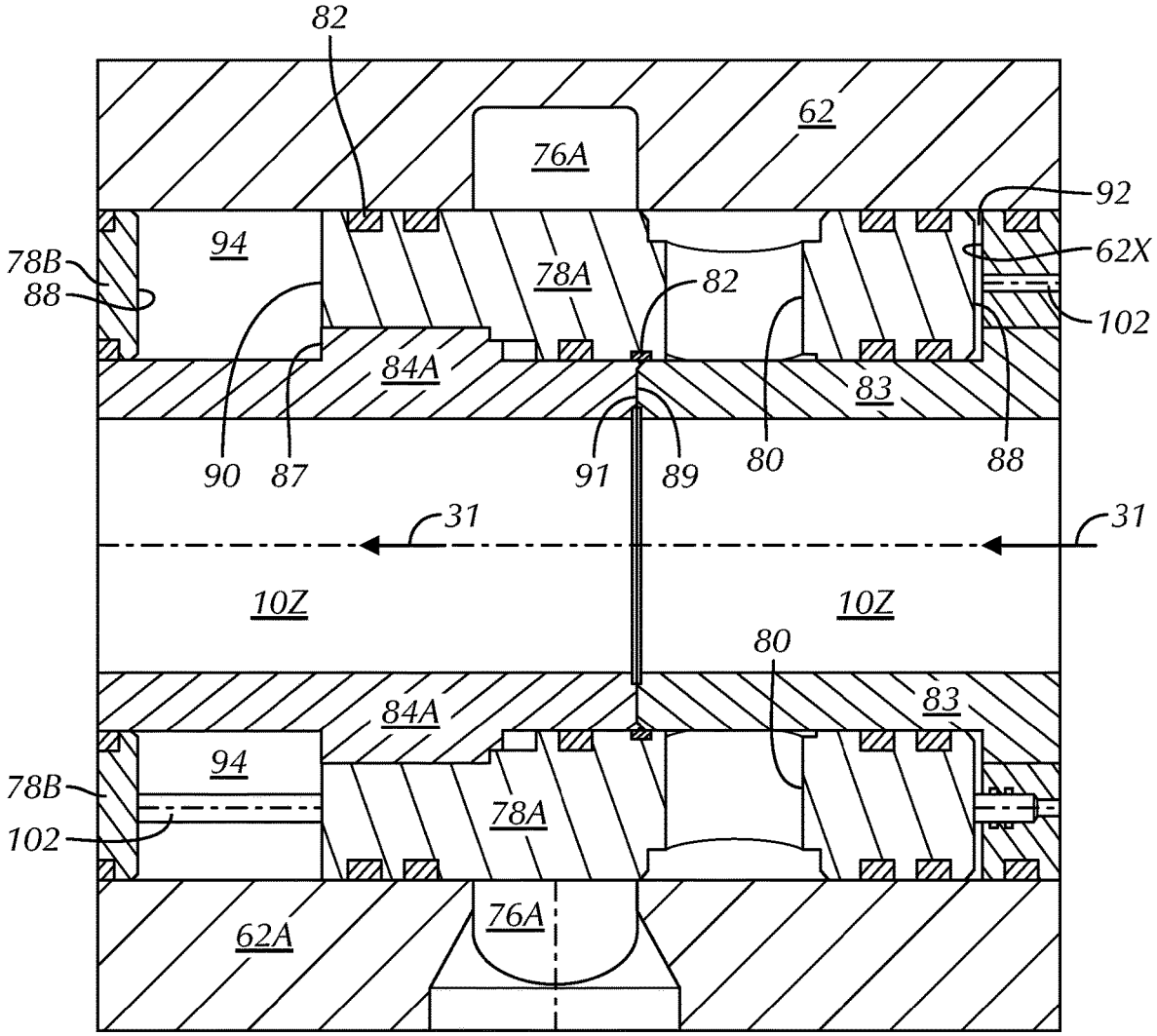

FIGS. 7 and 8 depict the diverter valve 60 when hydraulic pressure is applied to the hydraulic chamber 94. This is the "Well 2 Flow" position of the diverter valve 60. In the Well 2 Flow position, fracturing fluid 31 flows out of the dedicated fluid outlet 70 to well 2, while the flow of fracturing fluid 31 to all of the other wells 1, 3 and 4 is blocked.

Figure 6:
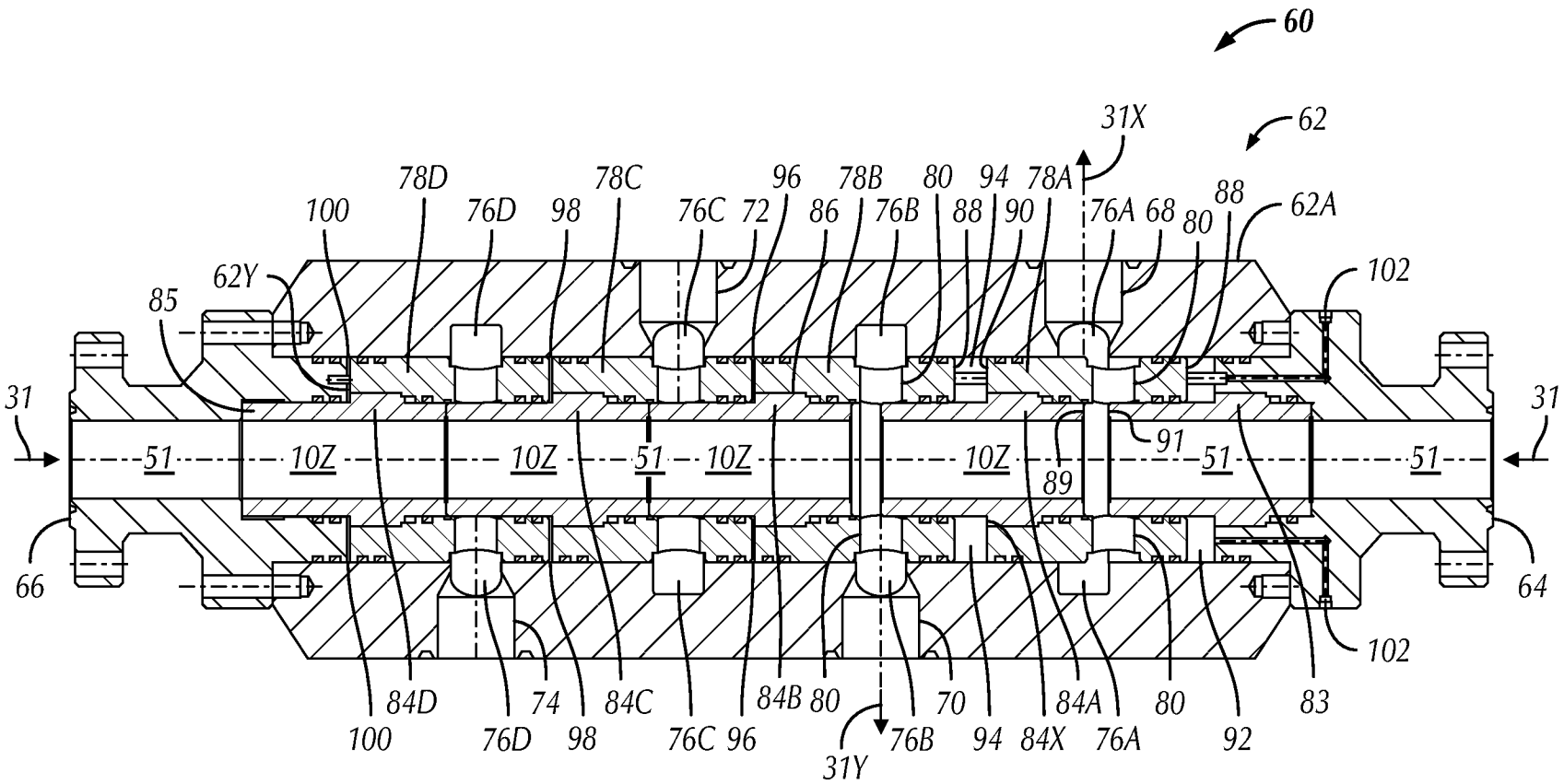

FIG. 6 depicts the diverter valve 60 at a point in time where it is in transition from the Well 1 Flow positon shown in FIG. 4, to the Well 2 Flow position shown in FIG. 7. To move from the Well 1 Flow position to the Well 2 Flow position, pressure is increased in the hydraulic chamber 94 while the hydraulic fluid within the hydraulic chamber 92 is allowed to bleed off. Hydraulic pressure within the chamber 94 acts on the second end surface 90 of the piston 78A to shift the piston 78A and its associated sliding sleeve 84A to the right. As depicted, the piston 78A has moved from the second piston position shown in FIG. 4 toward its first piston position, wherein the opening 80 is not-aligned with the flow gallery 76A. More specifically, FIG. 6 shows the piston 78A at a point in time where the piston 78A is between its second piston position (wherein the opening 80 is aligned with the flow gallery 76A—see FIG. 4) and its first piston position (wherein the opening 80 in the piston 78A is not aligned with the flow gallery 76A—see FIG. 3). The pressurized fluid in the chamber 94 acts on the annular end surface 84X of the sliding sleeve 84A and on the second end surface 90 of the piston 78A to drive the combination of the piston 78A and its associated sliding sleeve 84A toward the stationary sleeve 83. This movement causes the sliding sleeve 84A to separate from its abutting and sealing engagement with the sliding sleeve 84B. Note that, at the point of operation shown in FIG. 6, the opening(s) 80 in the piston 78A is still partially aligned with the fluid flow gallery 76A. Also note that, at the point of operation shown in FIG. 6, a portion of the opening(s) 80 in the piston 78B is uncovered and fluid communication is established between the primary fluid flow path 51, the opening(s) 80 in the piston 78B and the fluid flow gallery 76B. As a result, during this period of transition between closing the fluid outlet 68 and opening the fluid outlet 70, a first portion 31X of the fracturing fluid 31 that enters the diverter valve 60 will still flow out of the fluid outlet 68 toward well 1 while a second portion 31Y of the fluid 31 will flow out of the fluid outlet 70 toward well 2. As the piston 78A moves closer to the first piston position, the amount of the fluid 31X exiting the outlet 68 will gradually decrease and the amount of fluid 31Y exiting the outlet 70 will gradually increase.

As noted above, FIGS. 7 and 8 depict the diverter valve 60 in its final Well 2 Flow position. In the Well 2 Flow position, the position of the sleeves 83, 84B and 84C, respectively, prevent or block fluid 31 in the primary fluid flow path 51 from flowing to the opening(s) 80 in the pistons 78A, 78C and 78D, respectively, and the fluid flow galleries 76A, 76C and 76D. In the Well 2 Flow position, the opening(s) 80 in the annular piston 78B are no longer blocked by the sliding sleeve 84A. As a result, fracturing fluid 31 in the primary fluid flow path 51 is now free to flow through the opening(s) 80 in the piston 78B, into the fluid flow gallery 76B and out of the dedicated fluid outlet 70 to well 2. FIG. 8 is an enlarged view showing the sealing engagement between the end surface 89 of the sliding sleeve 84A and the end surface 91 of the stationary sleeve 83. Due to hydraulic pressure, the interface between the sleeves 84A and 83 is a pressure-tight seal. More specifically, sufficient hydraulic pressure is applied such that the contact stress between the end surface 89 and the end surface 91 exceeds the pressure within the primary fluid flow path 51 and effects a seal. The exact amount by which the contact stress between the end surfaces 89 and 91 exceeds the pressure within the primary fluid flow path 51 may vary depending upon the particular application. In some cases, the contact stress between the surfaces 89, 91 may be at least 50% greater than the pressure within the primary fluid flow path 51, but it may be higher or lower depending upon the nature and character of the end surfaces 89, 91. As depicted, a seal 82 is also positioned at this interface between the sleeves 84A, 83 when the piston 78A is in the first piston position. This sealing relationship applies equally with respect to the sealing and abutting engagement between and among the other sliding sleeves 84 as well.

Figure 9:
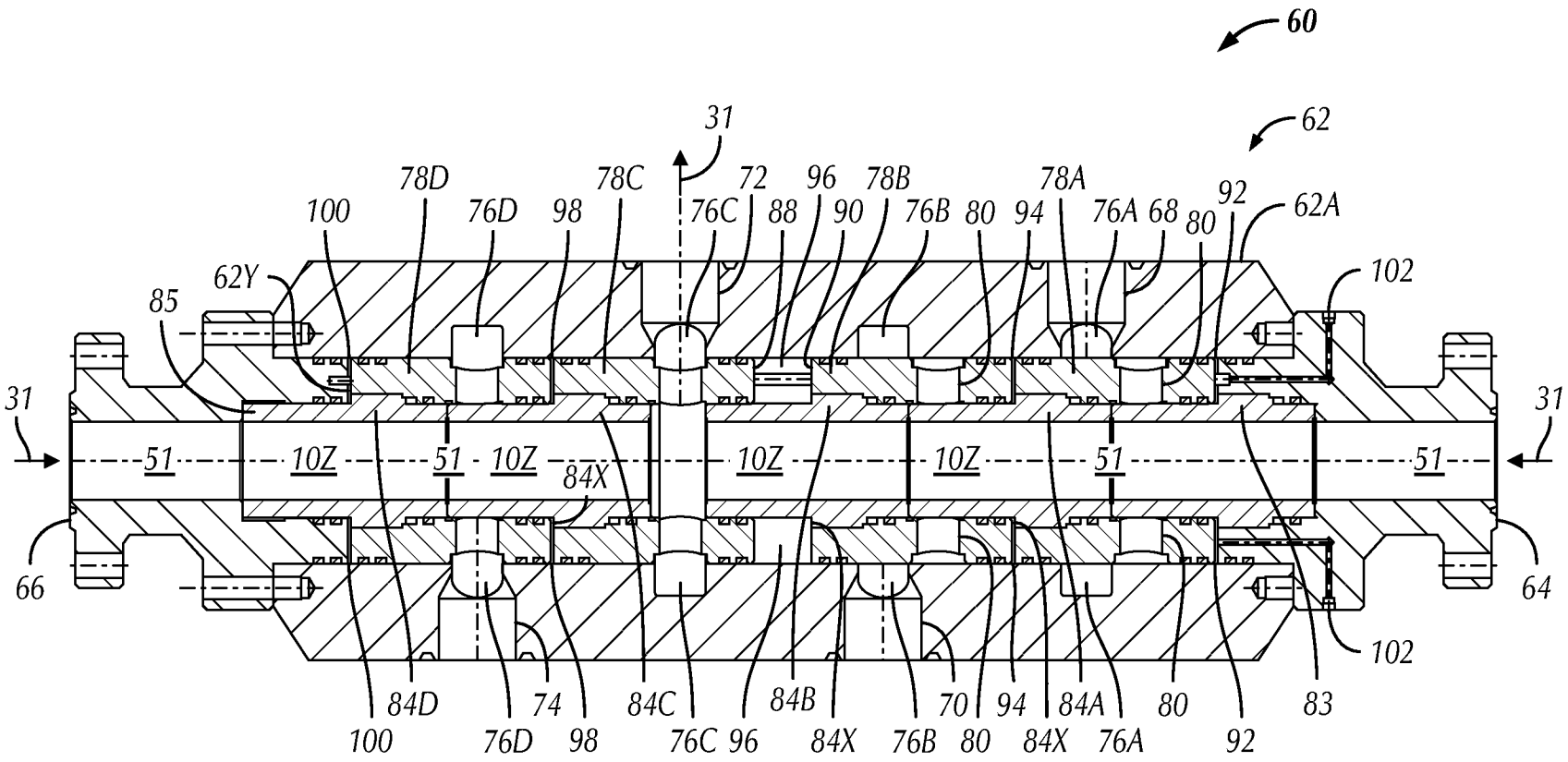

FIG. 9 depicts the diverter valve 60 when hydraulic pressure is applied to the hydraulic chamber 96. This is the "Well 3 Flow" position of the diverter valve 60. In the Well 3 Flow position, fracturing fluid 31 flows out of the fluid outlet 72 to well 3, while the flow of fracturing fluid 31 to all of the other wells 1, 2 and 4 is blocked. To move from the Well 2 Flow position shown in FIG. 7 to the Well 3 Flow position shown in FIG. 9, pressure is increased in the hydraulic chamber 96 while hydraulic fluid within the hydraulic chamber 94 is allowed to bleed off. The pressurized fluid in the chamber 96 acts on the annular surface 84X of the sliding sleeve 84B and on the second end surface 90 of the piston 78B to drive the combination of the piston 78B and its associated sliding sleeve 84B toward the combination of the sliding sleeve 84A and its associated piston 78A. This movement causes the sliding sleeve 84B to separate from its abutting and sealing engagement with the sliding sleeve 84C. Note that, in the positon shown in FIG. 9, the sliding sleeve 84B again sealingly abuts and engages the end surface of the sliding sleeve 84A. In the Well 3 Flow position, the position of the sleeves 83, 84A and 84C, respectively, prevent or block fluid 31 in the fluid flow path 51 from flowing to the opening(s) 80 in the pistons 78A, 78B and 78D, respectively, and the fluid flow galleries 76A, 76B and 78D, respectively. In this Well 3 Flow position, the opening(s) 80 in the piston 78C are no longer blocked by the sliding sleeve 84B. As a result, fracturing fluid 31 in the primary fluid flow path 51 is now free to flow through the opening(s) 80 in the piston 78C, into the fluid flow gallery 76C and out of the fluid outlet 72 to well 3.

Although not depicted in the drawings, to supply fracturing fluid to the fluid outlet 74 for well 4, while blocking flow of fracturing fluid 31 to wells 1, 2 and 3—the Well 4 Flow position—a process similar to those described above would be applied. To move from the Well 3 Flow position shown in FIG. 9 to the Well 4 Flow position (not shown), pressure is increased in the hydraulic chamber 98 while hydraulic fluid within the hydraulic chamber 96 is allowed to bleed off. The pressurized fluid in the chamber 98 acts on the annular surface 84X of the sliding sleeve 84C and on the second end surface 90 of the piston 78C to drive the combination of the piston 78C and its associated sliding sleeve 84C toward the combination of the sliding sleeve 84B and its associated piston 78B. This movement causes the sliding sleeve 84C to separate from its abutting and sealing engagement with the sliding sleeve 84D. Note that, in the position shown in FIG. 9, the sliding sleeve 84C would again sealingly abut and engage the end surface of the sliding sleeve 84B. In the Well 4 Flow position, the positions of the sleeves 83, 84A and 84B, respectively, prevent or block fluid 31 from flowing from the primary fluid flow path 51 to the opening(s) 80 in the pistons 78A, 78B and 78C, respectively, and to the fluid flow galleries 76A, 76B and 76C. In the Well 4 Flow position, the opening(s) 80 in the piston 78D are no longer blocked by the sliding sleeve 84C. As a result, fracturing fluid 31 in the primary fluid flow path 51 that enters the diverter valve 60 via the fluid flow ports 64, 66 is now free to flow through the opening(s) in the piston 78D, into the fluid flow gallery 76D and out of the dedicated fluid outlet 74 to well 4.

FIGS. 10-18 depict another illustrative embodiment of a diverter valve 60A and a different embodiment of the sliding sleeve valves 10 disclosed herein. Similar to the previous embodiment of the diverter valve 60 described above, the diverter valve 60A includes a plurality of sliding sleeve elements. However, the sliding sleeve elements in the diverter valve 60A comprise two sliding sleeves 107, 109 as compared to the previously disclosed embodiment wherein the sliding sleeve elements comprised only a single sliding sleeve 84. In the depicted example, the diverter valve 60A comprises four illustrative sliding sleeve valves 10A-D (collectively reference using the numeral 10) with dual sliding sleeves that are positioned in series in another illustrative embodiment of a diverter valve 60A.

In this illustrative example, each of the sliding sleeve valves 10 within the diverter valve 60A comprises a fluid flow gallery 76, a primary sliding sleeve 107, a secondary sliding sleeve 109 and a perforated piston 78, wherein at least one opening 80 is formed through the body of the piston 78. The piston 78, the primary sliding sleeve 107 and the secondary sliding sleeve 109 are adapted to be shifted axially within the body of the diverter valve 60A by application of hydraulic pressure to various hydraulic chambers as described more fully below. Of course, as noted above and as will be appreciated by those skilled in the art after a complete reading of the present application, the movement of the sliding sleeves 107, 109 and the pistons 78 may be accomplished by means other than hydraulic pressure. For example, the sliding sleeves 107, 109 and/or the pistons 78 could be configured such that they are adapted for movement by mechanical actuation using a variety of various known mechanical means. As before, each of the sliding sleeve valves 10 in the diverter valve 60A has an internal flow bore 10Z. As before, the internal flow bore 10Z in each of the valves 10 is substantially coaxial with the primary fluid flow path 51 through the overall diverter valve 60A.

As will be appreciated by those skilled in the art after a complete reading of the present application, the primary sliding sleeve 107 and the secondary sliding sleeve 109, when considered collectively, are adapted to be moved within the body of the diverter valve 60A from a first closed position to a second open position, and vice-versa. When the primary sliding sleeve 107 and the secondary sliding sleeve 109 are in the first closed position, fluid 31 flowing within the primary fluid flow path 51 is blocked from entering the opening 80 in the piston 78 and the fluid flow gallery 76. However, when the primary sliding sleeve 107 and the secondary sliding sleeve 109 are in the second open position, the flow of fluid 31 from the primary fluid flow path 51 to the opening 80 in the piston 78 and the fluid flow gallery 76 is not blocked.

Figure 10:
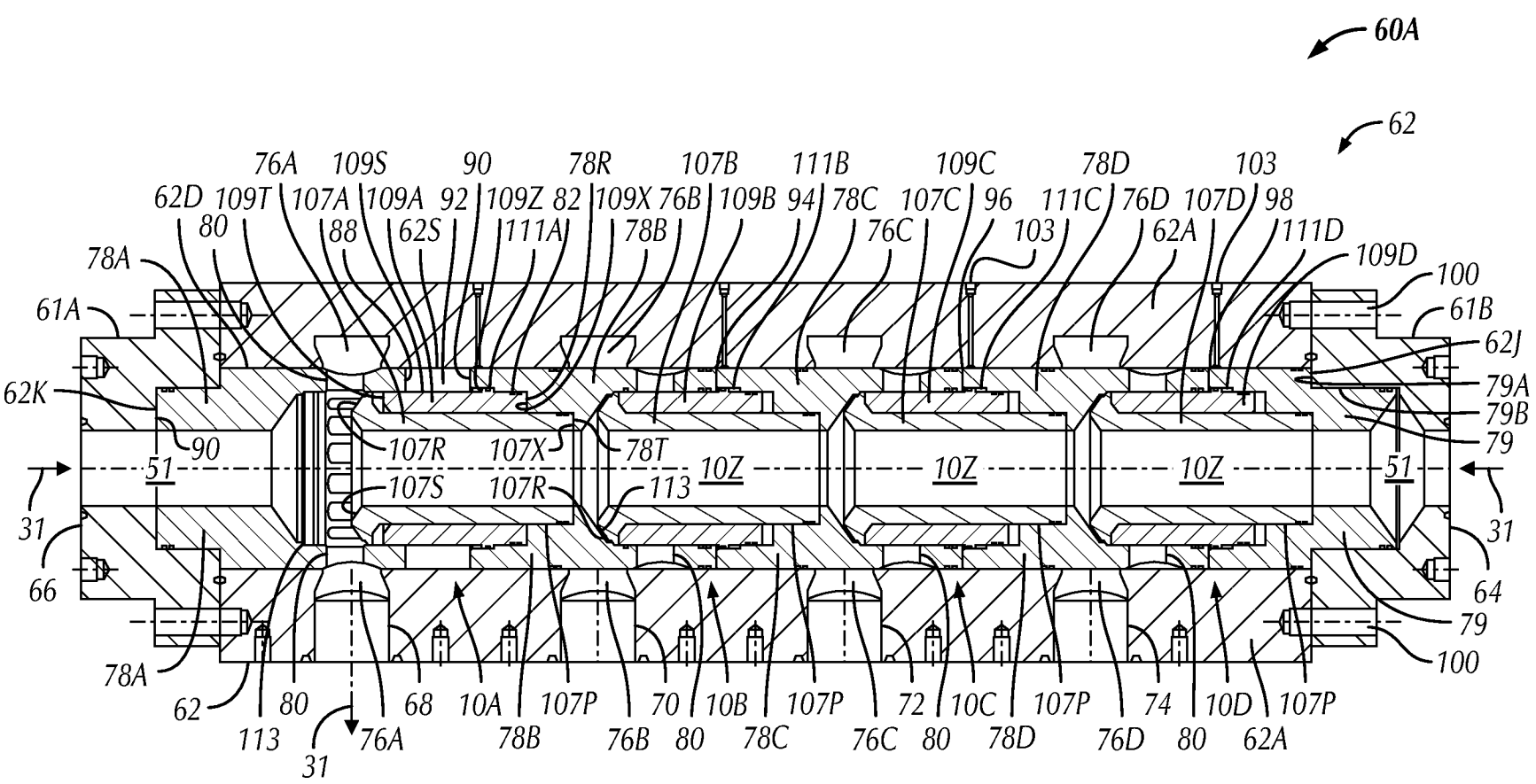
FIGS. 10-18 are various views of another illustrative embodiment of a diverter valve disclosed herein.
Figure 11:
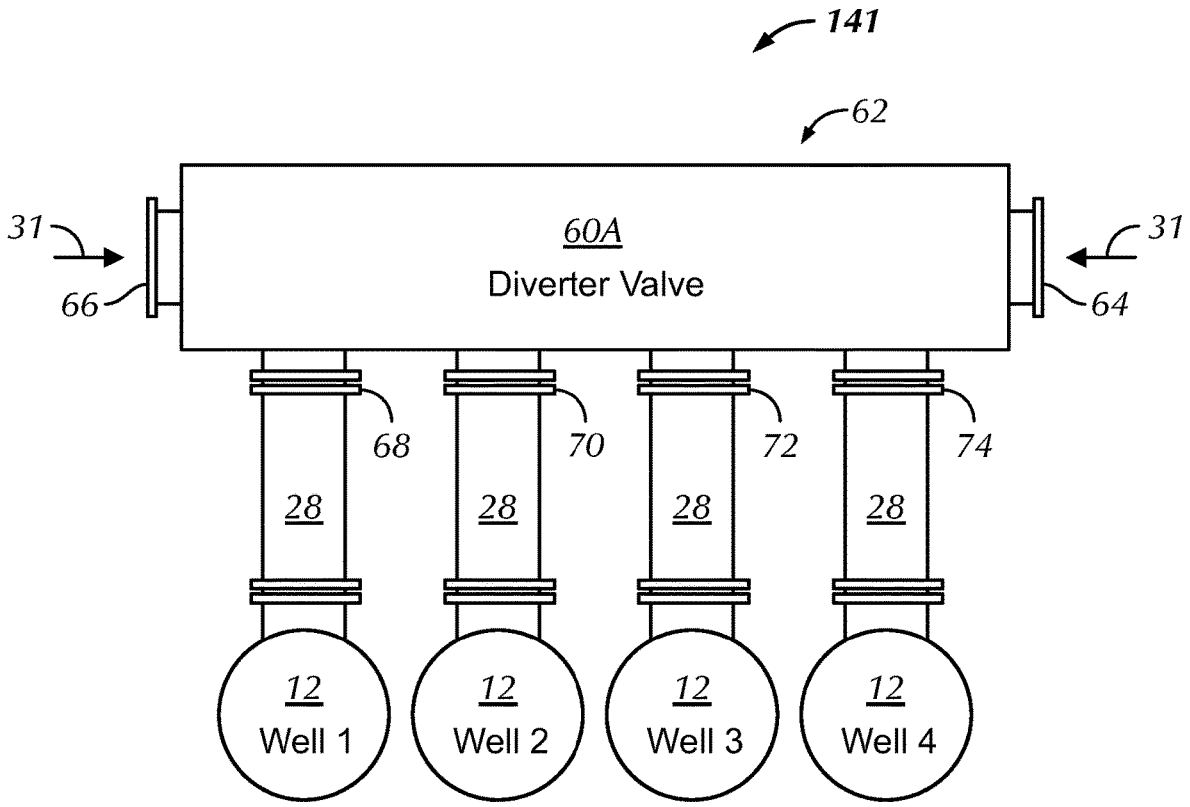

FIG. 10 is a cross-sectional view of the valve 60A when viewed from above. FIG. 11 is a simplistic plan view of an illustrative fracturing system 141 wherein the illustrative diverter valve 60A may be employed as part of a system for use in fracturing a plurality of oil and gas wells 12. In general, by use of the novel sliding sleeve valves 10 with dual sliding sleeves 107, 109 disclosed herein, this illustrative embodiment of the diverter valve 60A is also capable of selectively diverting fracturing fluid 31 to one of four illustrative wells (1-4). In effect, four of the sliding sleeve valves 10 with dual sliding sleeves 107, 109 are arranged in a serial fashion within the diverter valve 60A and each of these sliding sleeve valves 10 may be individually and selectively shifted (by application of hydraulic pressure) from a closed position to an open position such that fracturing fluid 31 flowing within the fluid flow path 51 of the valve 10 and the diverter vale 60A may be selectively supplied to one of the four wells 12 via dedicated flow conduits 28 that are operatively coupled to the dedicated outlets 68, 70, 72 and 74 in the diverter valve 60A. In the depicted example, the diverter valve 60A is configured to selectively supply fracturing fluid 31 to four wells. However, after a complete reading of the present application, those skilled in the art will appreciate that the diverter valve 60A may be designed to accommodate and function with any desired number wells, e.g., two wells, five wells, eight wells, etc.

Figure 16:
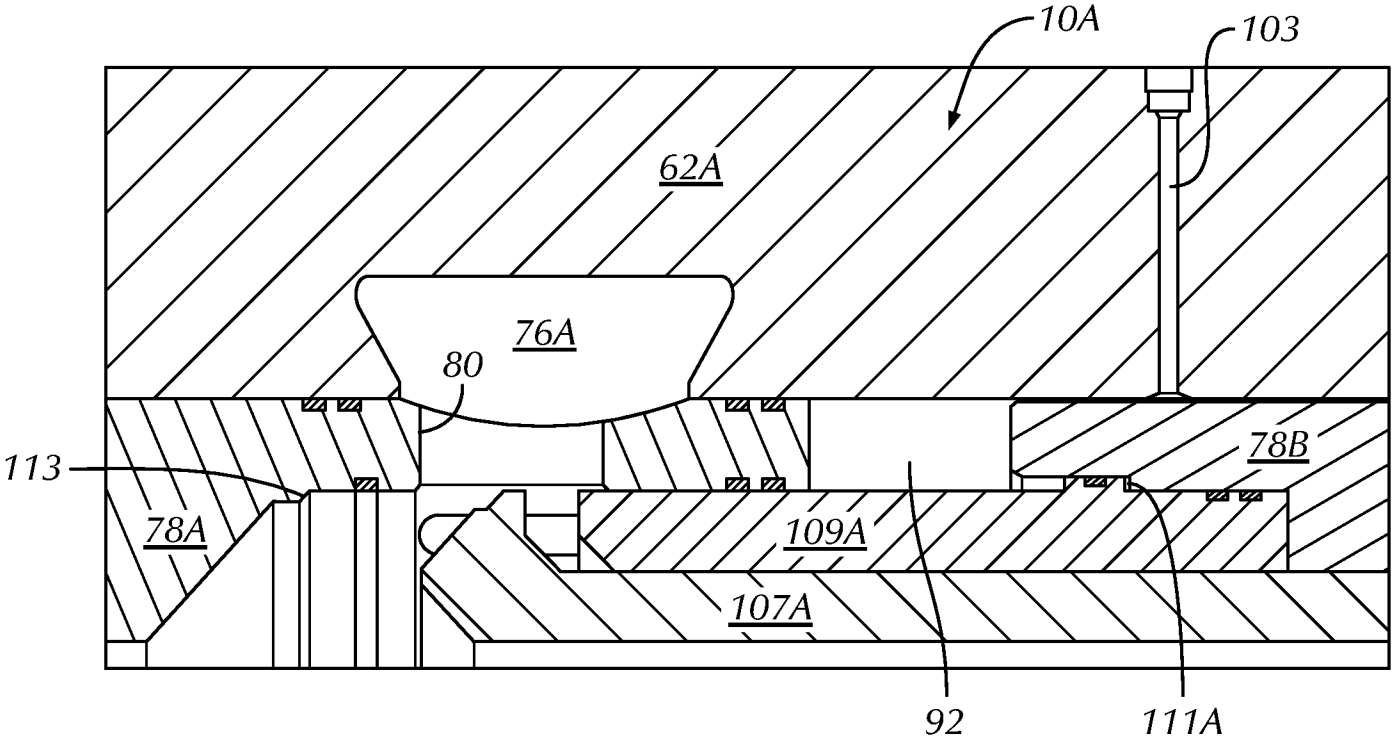
Figure 17:
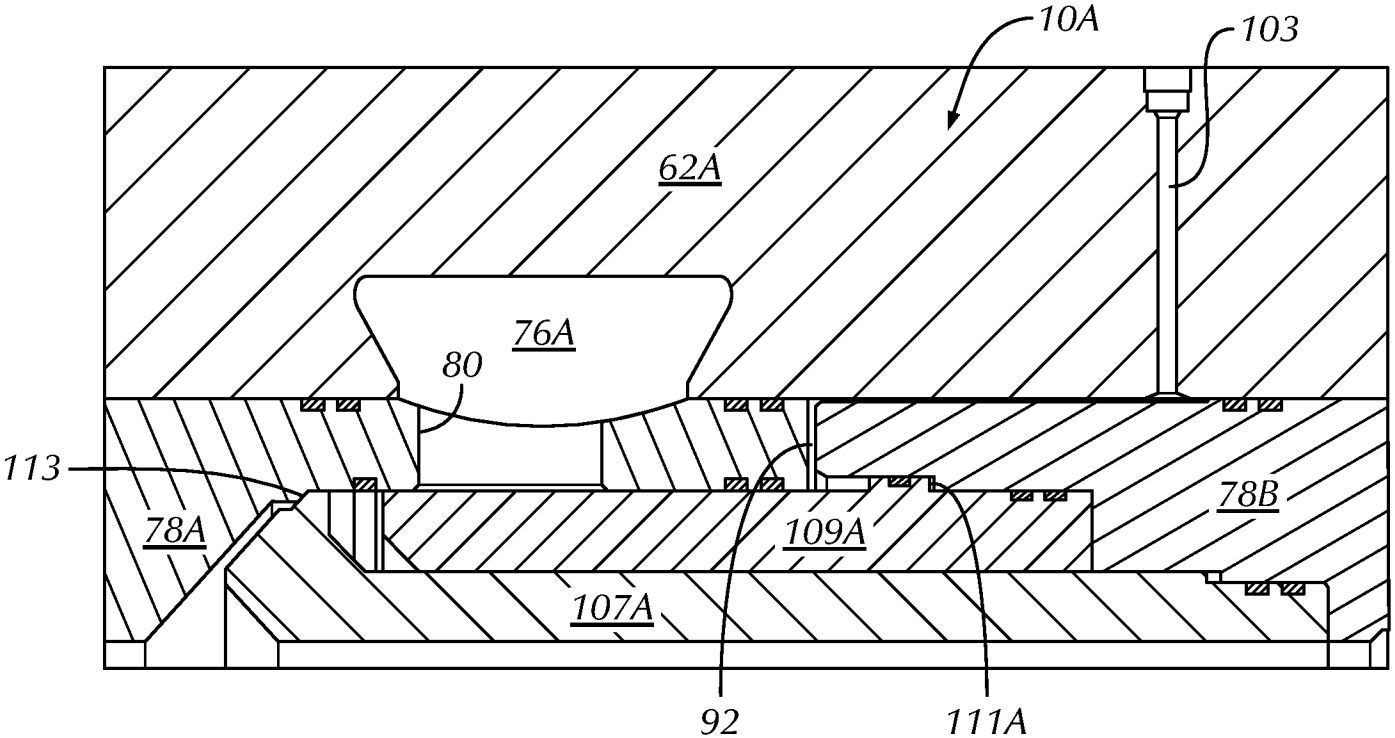
Figure 18:
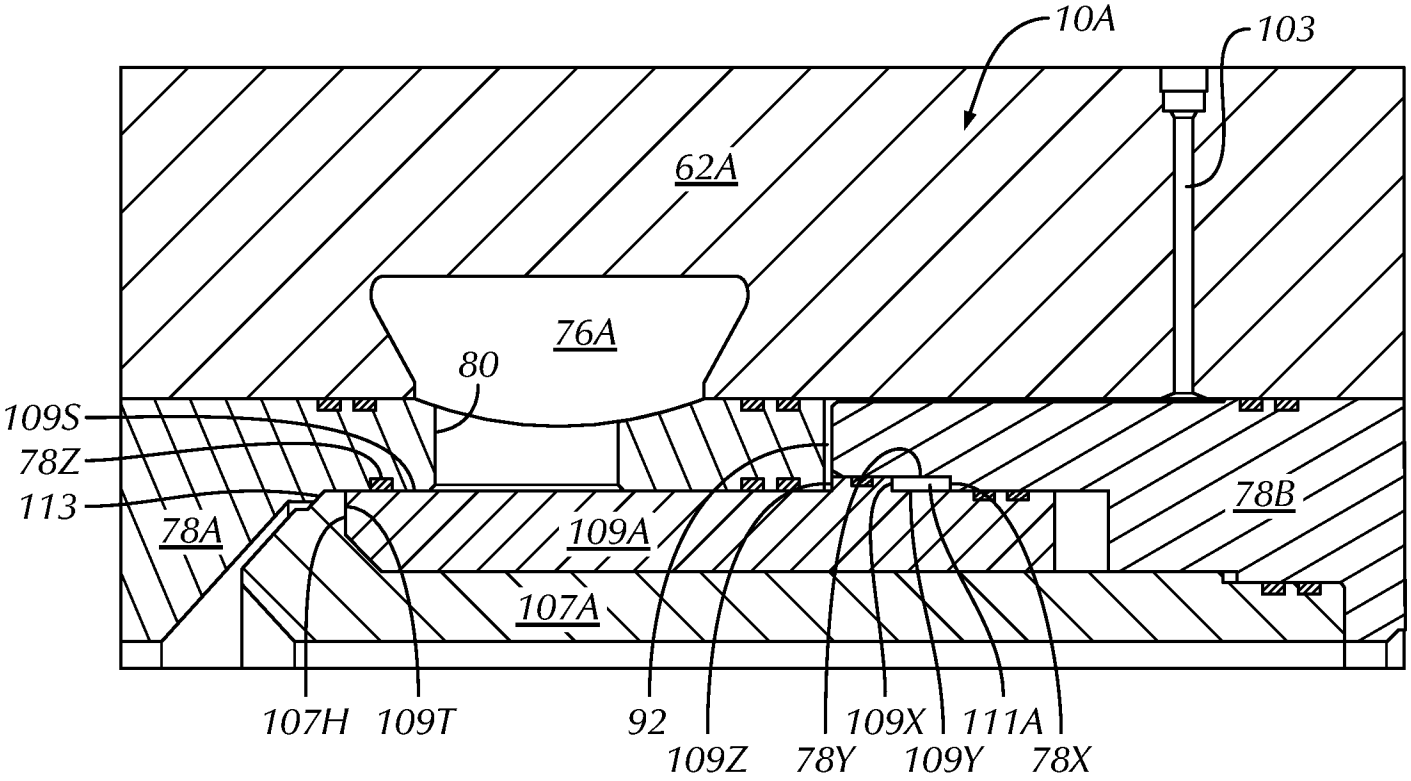

FIGS. 10 and 12-15 are cross-sectional views of the valve 60A that depict illustrative operational states or positions of the diverter valve 60A. FIGS. 16-18 are enlarged cross-sectional views of portions of the diverter valve 60A when it is in various operational states, as described more fully below.

As before, the diverter valve 60A comprises the body 62, the first fluid flow port 64, the second fluid flow port 66 and the primary fluid flow path 51. As before, in this embodiment, the diverter valve 60A also comprises a body 62 that comprises a main body portion 62A and first and second flanged structures 61A, 61B that are operatively coupled to the main body 62A by threaded fasteners. However, as before, the body 62 may have a different form as described above.

In the illustrative example of the diverter valve 60A shown herein, both of the fluid flow ports 64 and 66 are fluid inlets that allow fracturing fluid 31 to flow into the primary flow path 51 of the internal flow bore 10Z of the valves 10 within the diverter valve 60A. In other embodiments, one of the flow ports 64 may function as a fluid inlet (allowing fluid 31 to enter the diverter valve 60A) while the other fluid flow port 66 functions as a fluid outlet (allowing fluid 31 to exit the diverter valve 60A).

The diverter valve 60A also comprises the above-described plurality of dedicated fluid outlets for selectively directing fracturing fluid 31 to one of four wells: the fluid outlet 68 (for well 1), the fluid outlet 70 (for well 2), the fluid outlet 72 (for well 3) and the fluid outlet 74 (for well 4). In this particular embodiment, all of the fluid outlets 68, 70, 72 and 74 exit one side of the body 62 of the diverter valve 60A. As shown in FIG. 11, the dedicated fluid outlets 68, 70, 72 and 74 in the diverter valve 60A are operatively coupled to some form of dedicated fluid flow conduit 28, e.g., piping, flexible hose, that is in fluid communication with the corresponding well.

As before, the diverter valve 60A comprises a plurality of fluid flow galleries 76A-D (collectively referenced using the numeral 76) that are formed in the body 62 of the diverter valve 60A. As before, the fluid outlets 68, 70, 72 and 74 are, respectively, in dedicated fluid communication with the fluid flow galleries 76A, 76B, 76C and 76D, respectively. As before, the diverter valve 60A also comprises a plurality of perforated pistons 78A-78D (collectively referenced using the numeral 78) that are adapted to be shifted axially within the body 62 by application of hydraulic pressure to various hydraulic chambers, as will be described more fully below. In one illustrative embodiment, the pistons 78 may have a generally annular shaped configuration. As before, each of the pistons 78 comprises at least one of the above-described openings 80. This embodiment of the diverter valve 60A also includes another piston 79 (see the right side of FIG. 10). However, in this illustrative example, the piston 79 does not have an opening 80 formed therein. As before, each of the pistons 78, 79 have a first end surface 88 (to the right) and a second end surface 90 (to the left). As before, a plurality of the above-described illustrative seals 82 is positioned between and among the various components of the diverter valve 60.

The diverter valve 60A also includes a plurality of primary sliding sleeves 107A-D (collectively referenced using the numeral 107) and a plurality of secondary sliding sleeves 109A-D) (collectively referenced using the numeral 109). In this illustrative embodiment, the primary sliding sleeves 107A-D are mechanically coupled to the pistons 78B-D and 79, respectively, by a threaded connection 107P. Thus, the combination of the primary sliding sleeve 107A and the piston 78B (for example) move as a single unit when subjected to hydraulic pressure, as described more fully below. The same is true for the other combinations of sleeves 107 and pistons 78C-D and 79. The primary sliding sleeves 107 and the secondary sliding sleeves 109 are also adapted to be shifted axially within the body 62 by application of hydraulic pressure to various hydraulic chambers as will be described more fully below. As indicated, each of the secondary sliding sleeves 109 is positioned around and radially outward of their corresponding primary sliding sleeve 107. Additionally, at least a portion of a piston, e.g., the piston 78B, is positioned radially between at least a portion of a secondary sliding sleeve 109, e.g., the sliding sleeve 109B, and the internal surface 62S of the body 62 of the diverter valve 60A.

The diverter valve 60A also includes a plurality of primary hydraulic chambers 92, 94, 96, 98 and 100 and a plurality of secondary hydraulic chambers 111A-D (collectively referenced using the numeral 111). As described more fully below, when pressurized hydraulic fluid is selectively applied to certain of these hydraulic chambers 92, 94, 96, 98, 100 and 111, various components of the diverter valve 60A, e.g., the pistons 78, the primary sliding sleeves 107 and/or the secondary sliding sleeves 109, may be moved into an operational position whereby fracturing fluid 31 may be selectively directed to one of the wells 12 or to an operational position wherein the flow of fracturing fluid 31 to all of the wells 12 is prevented. More specifically, supplying hydraulic pressure to the hydraulic chambers 92, 94, 96 and 98 will allow fracturing fluid 31 to be selectively directed to wells 1, 2, 3 and 4, respectively, via the dedicated fluid outlets 68, 70, 72 and 74, respectively. Supplying hydraulic pressure to the hydraulic chamber 100 will block the flow of fracturing fluid 31 to all of the wells 12.

As described more fully below, supplying hydraulic pressure to certain of the hydraulic chambers 92, 94, 96, 98 and 100 will cause the primary sliding sleeve 107 on certain of the valves 10 to move from a first position to a second position, and vice, versa. As described more fully below, supplying hydraulic pressure to the hydraulic chambers 111 will cause the secondary sliding sleeve 109 to move to a position wherein the secondary sliding sleeve 109 sealingly engages a seal (described below) in its associated piston. Considered collectively, the primary sliding sleeve 107 and the secondary sliding sleeve 107 may be moved from a first position to a second position, and vice-versa, by application of hydraulic power. In the first position, the combination of the sleeves 107, 109 block fluid 31 flowing in the primary flow path 51 from entering the opening(s) 80 in the piston 78 (and the fluid flow gallery 76), thereby preventing the flow of fracturing fluid 31 in the primary flow path 51 to a particular well. In the second position, the combination of the sleeves 107, 109 do not block the flow of fluid 31 from the primary flow path 51 from entering the opening(s) 80 in the piston 78 (and the fluid flow gallery 76), thereby allowing the flow of fracturing fluid 31 in the primary flow path 51 to a particular well. As will be appreciated by those skilled in the art after a complete reading of the present application, the secondary sliding sleeve 109 provides a secondary pressure barrier between the opening 80 in the piston 78 (and thus the flow gallery 76) and the fluid 31 flowing in the primary fluid flow path 51.

With reference to FIG. 10, the hydraulic chamber 92 is approximately defined by the first end surface 88 of the piston 78A, the second end surface 90 of the piston 78B, the inner surface 62S of the body 62 and the outer surface 109S of the secondary sliding sleeve 109A. FIG. 10 depicts the hydraulic chamber 92 when hydraulic pressure has been applied to the hydraulic chamber 92. In the position shown in FIG. 10, the piston 78A has moved to its left-most position within the body 62 wherein the second end surface 90 of the piston 78A abuts and engages an interior surface 62K of the body 62 and wherein the opening 80 in the piston 78A is substantially aligned with the fluid flow gallery 76A. This is the Well Flow 1 position of the diverter valve 60A.

The hydraulic chamber 94 (shown in a non-pressurized state in FIG. 10) is approximately defined by the first end surface 88 of the piston 78B, the second end surface 90 of the piston 78C, the inner surface 62S of the body 62 and the outer surface 109S of the secondary sliding sleeve 109B. The hydraulic chamber 96 (shown in a non-pressurized state in FIG. 10) is approximately defined by the first end surface 88 of the piston 78C, the second end surface 90 of the piston 78D, the inner surface 62S of the body 62 and the outer surface 109S of the secondary sliding sleeve 109C. The hydraulic chamber 98 (shown in a non-pressurized state in FIG. 10) is approximately defined by the second end surface 90 of the piston 79, the first end surface 88 of the piston 78D, the inner surface 62S of the body 62 and the outer surface 109S of the secondary sliding sleeve 109D. The hydraulic chamber 100 (shown in a non-pressurized state in FIG. 10) is approximately defined by a substantially vertically oriented surface 79A of the piston 79, an interior surface 62J of the body 62, the inner surface 62S of the body 62 and a substantially horizontally oriented surface 79B on the piston 79.

FIG. 10 depicts the diverter valve 60A in a position wherein the secondary hydraulic chamber 111A is in a non-pressurized state. However, in FIG. 18, the secondary hydraulic chamber 111A is shown in a pressurized state. With reference to FIG. 18, the secondary hydraulic chamber 111A is approximately defined by a substantially vertically oriented surface 78X on the piston 78B, a substantially horizontally oriented surface 78Y on the piston 78B, a substantially vertically oriented surface 109X on the secondary sliding sleeve 109A and a substantially horizontally oriented surface 109Y on the secondary sliding sleeve 109A. The other secondary hydraulic chambers 111B-D have a similar configuration to that of the chamber 111A, i.e., the other secondary hydraulic chambers 111B-D are defined by corresponding structures on adjacent pistons and corresponding secondary sliding sleeves 109B-D.

FIG. 10 depicts the diverter valve 60A in a position wherein the secondary hydraulic chamber 111A is in a non-pressurized state while all of the other secondary hydraulic chambers 111B-D are shown in their pressurized state. As noted above, hydraulic pressure may be applied to the hydraulic chambers 92, 94, 96, 98, 100 and 111 by traditional hydraulic ports, conduits, valves and systems that are known to those skilled in the art and thus will not be depicted or described in any great detail so as not to obscure the various inventions disclosed herein. In one illustrative example, hydraulic pressure may be supplied to the secondary hydraulic chambers 111 by hydraulic porting (not shown) that extend through the pistons 78, 79.

Although not depicted in the drawings, when hydraulic pressure is applied to the hydraulic chamber 100, all of the pistons 78 and the primary sliding sleeves 107 will be moved to their left-most position within the body 62 of the diverter valve 60A. Assuming hydraulic pressure is applied to all of the hydraulic chambers 111, the secondary sliding sleeves 109 would also be moved to their left-most position within the diverter valve 60A and thereby engage the seat 113 (described below) of its associated piston. That is, when the hydraulic chamber 100 and all of the hydraulic chambers 111 are pressurized (or energized), the diverter valve 60A is in its Fully Closed position. Note that, in the Fully Closed position, the end surface 79A of the sliding sleeve 79 would be spaced apart from the surface 62J in the body 62.

In the Fully Closed position (not shown), the fracturing fluid 31 that enters the primary fluid flow path 51 of the diverter valve 60A via the flow ports 64 and 66 is blocked from flowing to any of the four wells. In this particular embodiment, the piston 78A is mechanically coupled to the body 62 by a threaded connection 62D (see FIG. 10). All of the other pistons 78B-D and 79 may be moved axially within the body 62 by application of hydraulic pressure. The pressurized fluid in the chamber 100 acts on the annular surface 79A of the sliding sleeve 79 to drive all of the pistons 78B-D and 79 to their left-most position within the body 62 of the diverter valve 60A. In this most left-most position, all of the pistons 78A-D are in their second piston position, wherein the opening(s) 80 in each of the pistons 78 is substantially aligned with its corresponding fluid flow gallery 76. More specifically, in this Fully Closed position, the second end surface 90 of the piston 78B abuts and engages the first end surface 88 of the piston 78A, the second end surface 90 of the piston 78C abuts and engages the first end surface 88 of the piston 78B, the second end surface 90 of the piston 78D abuts and engages the first end surface 88 of the piston 78C and the second end surface 90 of the piston 79 abuts and engages the first end surface 88 of the piston 78D.

The pistons 78B-D and 79 have substantially vertically oriented internal shoulders or surfaces 78R and 78T. The internal shoulder 78R is adapted to engage an end surface 109X of the secondary sliding sleeve 109. The internal shoulder 78T is adapted to engage an end surface 107X of the primary sliding sleeve 107. Thus, leftward movement of the pistons 78B-D and 79 forces the primary sliding sleeves 107 to their left-most position within the body 62, i.e., wherein the end sealing surface 107R of the primary sliding sleeve 107 is urged into sealing engagement with a seat 113 in its associated piston 78. With reference to FIG. 10, the end sealing surface 107R of the primary sliding sleeve 107A is not sealed against the seat 113 in the piston 78A. However, the end sealing surface 107R of the primary sliding sleeves 107B-D is sealed against the seat 113 in the pistons 78B-D, respectively.

While the secondary sliding sleeves 109 also move to the left when the pistons 78B-D and 79 are driven to the left, the secondary sliding sleeves 109 are not in their final left-most position within the body 62 until such time as the hydraulic chambers 111 are energized with hydraulic pressure. In FIG. 10, the hydraulic chambers 111B-D are energized, thereby forcing the secondary sliding sleeves 109B-D, respectively, into engagement with the primary sliding sleeves 107B-D, respectively. In FIG. 10, the hydraulic chamber 111A is not energized and, accordingly, an end surface 109T of the secondary sliding sleeve 109A is not engaged with the primary sliding sleeve 107A.

FIG. 18 is an enlarged view showing the diverter valve 60A when the hydraulic chamber 111A is energized thereby forcing the secondary sliding sleeve 109A into engagement with the primary sliding sleeve 107A. As depicted, the primary sliding sleeve 107A is in sealed engagement with its seat 113 in the piston 78A. Thereafter, hydraulic pressure was supplied to the hydraulic chamber 111A to drive the secondary sliding sleeve 109A to the left where the end surface 109T of the secondary sliding sleeve 109A abuts and engages a surface 107H of the primary sliding sleeve 107A. In this position, the outer surface 109S of the secondary sliding sleeve 109A adjacent the end surface 109T seals against a seal (not shown) positioned in a seal recess 78Z formed in the piston 78A. In the Fully Closed position, the opening 80 in each of the pistons 78 is aligned with its corresponding fluid flow gallery 76, but the combination of the primary sliding sleeves 107 and the secondary sliding sleeves 109, i.e., two pressure barriers, prevent fluid communication between the opening(s) 80 in each of the pistons 78 (and the corresponding fluid flow gallery 76) and the primary fluid flow path 51 and the internal flow bore 10Z within the valves 10.

FIG. 10 depicts the diverter valve 60A when hydraulic pressure is applied to the hydraulic chamber 92 to thereby selectively direct the flow of fracturing fluid 31 out of the fluid outlet 68 to well 1, while blocking the flow of fracturing fluid 31 to any of the other wells 2-4—this is the "Well 1 Flow" operating position of the diverter valve 60A. Hydraulic pressure is maintained in the hydraulic chambers 111B-D when the diverter valve 60A is in the Well 1 Flow position.

To move the diverter valve 60A from the Fully Closed position (described above) to the Well 1 Flow position shown in FIG. 10, pressure is increased in the hydraulic chamber 92 while hydraulic fluid within the hydraulic chamber 100 and the hydraulic chamber 111A is allowed to bleed off. In one illustrative sequence, the pressure within the hydraulic chamber 111A is bled first so as to insure that the secondary sliding sleeve 109A opens before the primary sliding sleeve 107A opens. The sequence preserves the radial seal between the primary sliding sleeve 109A and the piston 78A Hydraulic pressure is maintained in the hydraulic chambers 111B-D to keep the secondary sliding sleeves 109B-D in their closed position. Additionally, the hydraulic chambers 94, 96 and 98 are vented so that preload can be maintained on all of the seats 113 except for the seat 113 that was engaged by the primary sliding sleeve 109A. Hydraulic pressure within the chamber 92 acts to drive the pistons 78B, 78C, 78D and 79 and the primary sliding sleeves 107B-D to their right-most position within the body 62. In this right-most position, the pistons 78B-D are in their first piston position wherein the opening(s) 80 in the piston 78B-D is not aligned with its corresponding flow gallery 78B-D. The pressure within hydraulic chambers 111B-D maintains the mechanical engagement between the secondary sliding sleeves 109B-D and their associated primary sliding sleeves 107B-D, respectively. With the pressure released within the chamber 111A, the secondary sleeve 109A is allowed to move to the right and the primary sleeve 107 is also free to move to the right. Hydraulic pressure within the hydraulic chamber 92 acts on the second end surface 90 of the piston 78B and on the shoulder 109Z (see FIG. 18) of the secondary sliding sleeve 109A. The pressure acting on the shoulder 109Z moves the secondary sliding sleeve 109A to the right. As will be appreciated by those skilled in the art after a complete reading of the present application, the secondary sliding sleeves disclosed herein are always pressure balanced with respect to the pressure of the fracturing fluid 31. Hydraulic pressure within the chamber 92 also acts on the first end surface 88 of the piston 78A. As pressure is bled from the chamber 100, the pistons 78B-D and 79 will all move to the right. Of course, the above sequence is based upon the chamber 100 being initially pressurized. However, the same sequence would apply to the other chambers 84, 96 or 98 depending upon which outlet was previously open. This sequence preserves the radial seal between the seal (not shown) positioned in the seal recess 78Z (see FIG. 18) and the outer surface 109S of the secondary sliding sleeve 109A and the piston 78A as the secondary sliding sleeve 109A moves relative to the piston 78A. On the other hand, the seat 113 may typically be a metal sealing surface and will be much more robust when opening under a pressure differential with respect to the pressure of the fracturing fluid. As depicted, movement of the primary sliding sleeve 107A and the secondary sliding sleeve 109A to the positions shown in FIG. 10 allows fluid flowing within the primary fluid flow path 51 to enter the opening(s) 80 in the piston 78A and the fluid flow gallery 76A. Accordingly, fracturing fluid 31 may flow from the primary fluid flow path 51, through the opening(s) 80 in the piston 78A, into the fluid flow gallery 76A and out of the dedicated fluid outlet 68 to well 1, all while the flow of fracturing fluid 31 to wells 2-4 is prevented.

Figure 12:
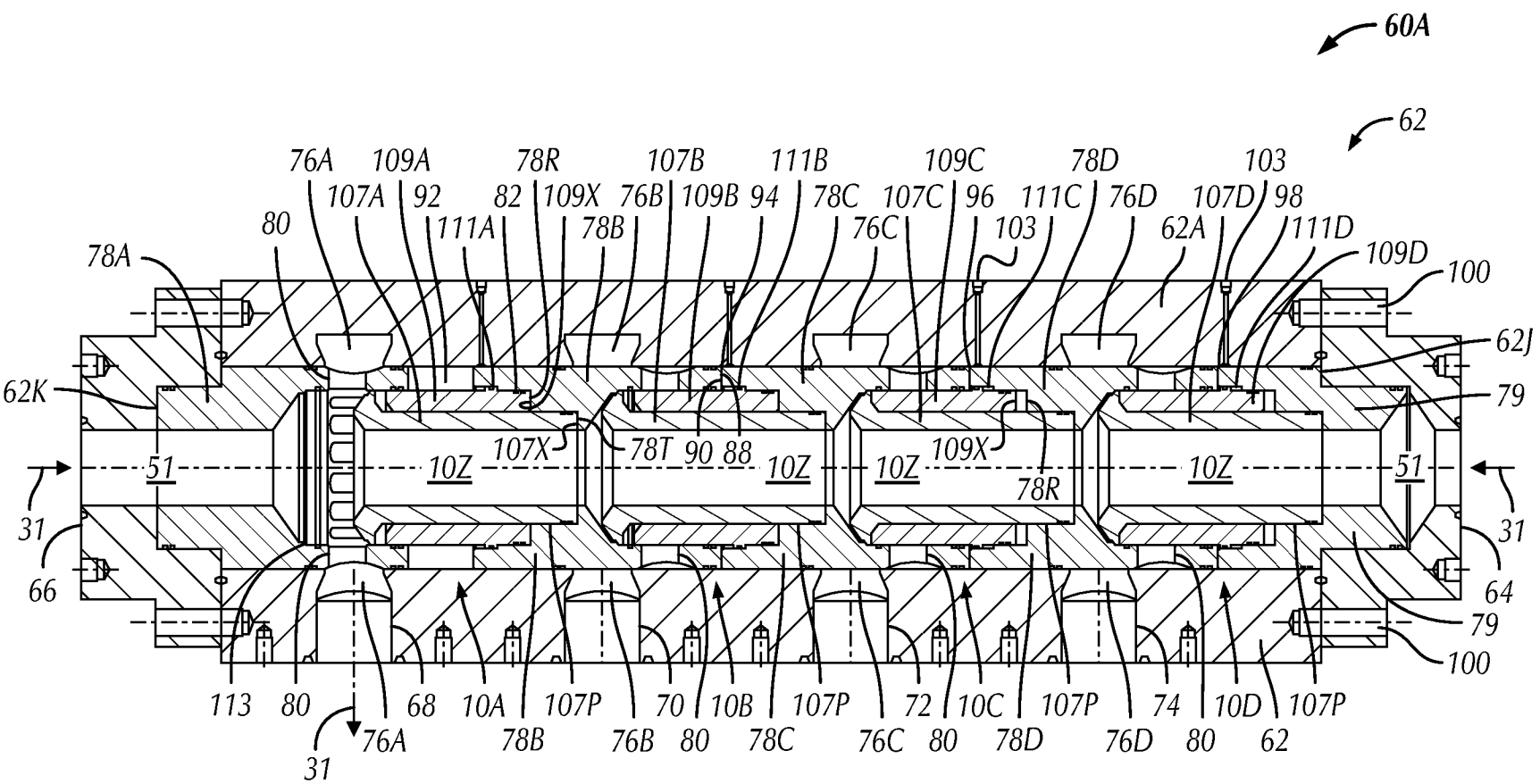
Figure 13:
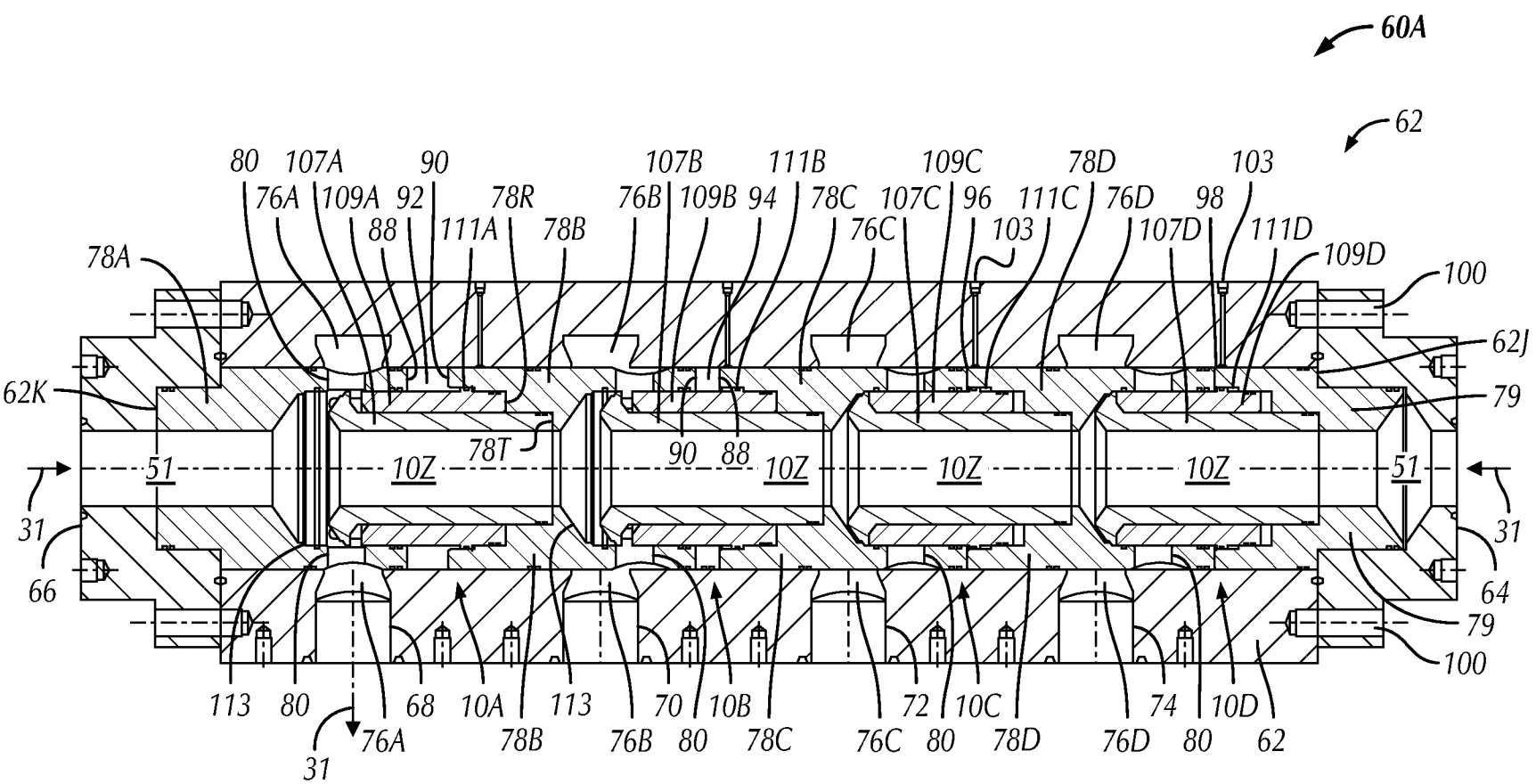
Figure 14:
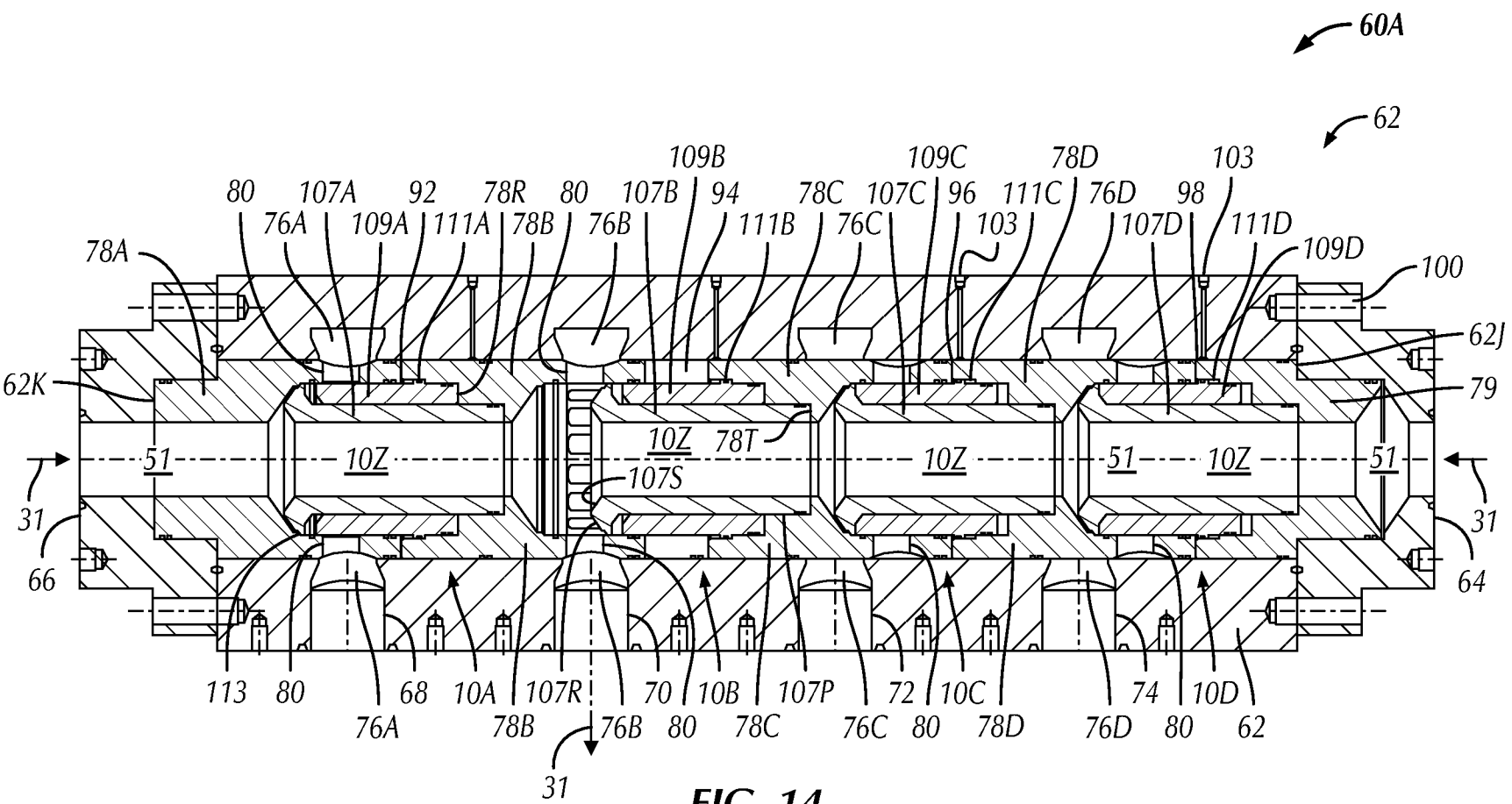
Figure 15:
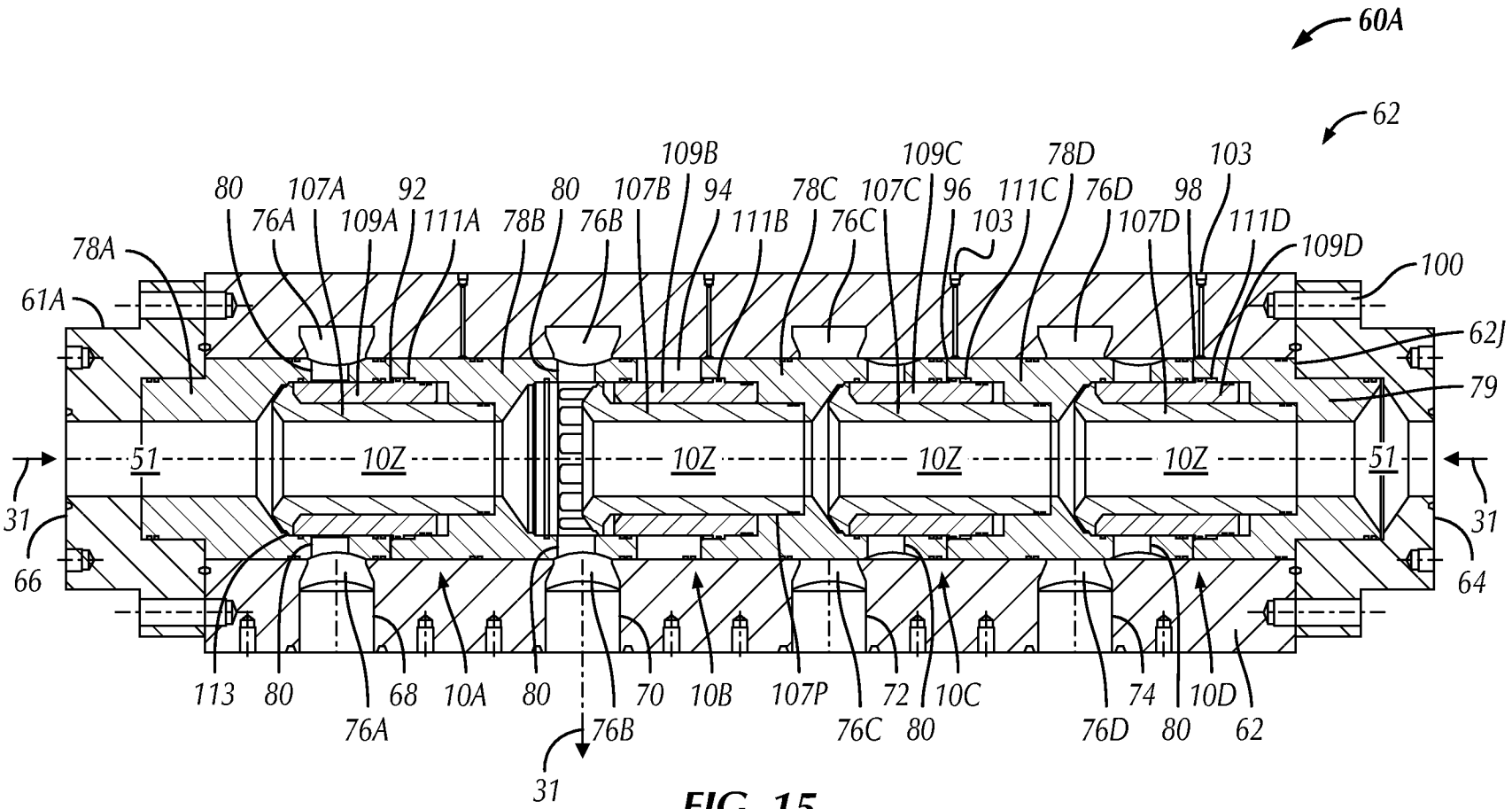

FIGS. 12-14 depict the diverter valve 60A at a point in time wherein it is desired to transition from the operational Well 1 Flow position shown in FIG. 10 to another operational position—the "Well 2 Flow" position—shown in FIG. 14. In the Well 2 Flow position, fracturing fluid 31 flowing in the primary fluid flow path 51 is allowed to flow out of the fluid outlet 70 to well 2, while the flow of fracturing fluid 31 to all of the other wells 1, 3 and 4 is blocked.

To move from the Well 1 Flow position, shown in FIG. 10, to the Well 2 Flow position, shown in FIG. 14, pressure is initially reduced in the hydraulic chamber 111B to release the secondary sliding sleeve 109B. At that point, hydraulic pressure is increased and maintained in the hydraulic chamber 94 and then the hydraulic fluid within the hydraulic chamber 92 is allowed to bleed off. FIGS. 13 and 16 depict the diverter valve 60A at a point in time wherein pressure within the chamber 94 has caused the piston 78B to begin to move to the left. Note the space between the first end surface 88 of the piston 78C and the second end surface 90 of the piston 78B in FIG. 13. Due to the engagement of the internal shoulders 78T and 78R on the piston 78B with the primary sliding sleeve 107A and the secondary sliding sleeve 109A, respectively, the primary sliding sleeve 107A and the secondary sliding sleeve 109A also move to the left as the piston 78B moves to the left. Note that, in the position shown in FIGS. 13 and 16, the primary sliding sleeve 107A now partially blocks the opening(s) 80 in the piston 78A as some amount of fracturing fluid 31 continues to flow out of the fluid outlet 68 to well 1. Also note that, at the point shown in FIG. 13, leftward movement of the piston 78B has caused the primary sliding sleeve 107B to become disengaged from the seat 113 formed in the piston 78B. At this point, the flow of any substantial amount of fracturing fluid 31 out of the fluid outlet 70 (to well 2) remains blocked but the fluid outlet 70 remains in fluid communication with the fracturing fluid 31 in the primary fluid flow path 51. As the piston 78B travels further to the left, the flow of fracturing fluid 31 transitions from primarily flowing to well 1 to primarily flowing to well 2. As shown in FIG. 14, when the primary sliding sleeve 107A and the secondary sliding sleeve 109A are fully engaged with the piston 78A (as described above) a flow of fracturing fluid 31 to well 1 is blocked and all of the fracturing fluid 31 in the primary fluid flow path 51 flows out of the outlet 70 to well 2. Both of the chambers 111A and 111B are in a non-pressurized state at the point shown in FIGS. 13 and 16. However, the hydraulic pressure is maintained in the chambers 111C and 111D at the point shown in FIGS. 13 and 16.

With reference to FIGS. 13 and 14, the hydraulic pressure within the chamber 94 continues to drive the piston 78B to the left until the second end surface 90 (see FIG. 13) of the piston 78B abuts and engages the front end surface 88 of the piston 78A. At this point, the piston 78B is in the second piston position wherein the opening 80 in the piston 78B is substantially aligned with the flow gallery 76B. Hydraulic pressure is maintained in the hydraulic chambers 111C-D as the diverter valve 60A transitions from the Well Flow 1 (FIG. 10) to the Well Flow 2 position (FIG. 14). As the piston 78B moves to the left, the internal shoulder 78T on the piston 78B engages the primary sliding sleeve 107A and, along with the threaded connection 107P, absorbs the forces as the primary sliding sleeve 107A is driven into sealing engagement with the seat 113 in the piston 78A. The internal shoulder 78R on the piston 78B also engages the secondary sliding sleeve 107A as the piston 78B moves to the left thereby causing the secondary sliding sleeve 107A to move to the left. Once the piston 78B engages the piston 78A, the primary sliding sleeve 107A is in sealed engagement with the seat 113 in the piston 107A. Thereafter, pressure is applied to the chamber 111A to drive the secondary sleeve 107A into sealing engagement with the piston 78A. In this position, the combination of the primary sliding sleeve 107A and the secondary sliding sleeve 109A block fluid 31 flowing in the primary fluid flow path 51 and the internal flow bore 10Z of the valves from entering the opening 80 in the piston 76A (and the corresponding fluid flow gallery 76A).

With continued reference to FIG. 14, in the depicted position, the primary sliding sleeve 107B is pressure balanced with respect to the fracturing fluid 31 and the primary sliding sleeve 107B is maintained in the depicted position due to the threaded connection 107P between the piston 78C and the primary sliding sleeve 107B. The chamber 111B remains in a non-pressurized state in the Well 2 Flow position shown in FIG. 14. At the position shown in FIG. 14, fluid communication is established between the primary flow path 51, the opening(s) 80 in the piston 78B and the fluid flow gallery 76B. Accordingly, fracturing fluid 31 may flow from the primary flow path 51, through the opening(s) 80 in the piston 78B, into the fluid flow gallery 76B and out of the dedicated fluid outlet 70 to well 2, all while the flow of fracturing fluid 31 to wells 1 and 3-4 is prevented.

As will be appreciated by those skilled in the art after a complete reading of the present application, the above-described operational sequence may be applied to selectively direct fracturing fluid 31 out of the fluid outlet 72 to well 3—the "Well 3 Flow" position—via the valve 10C while blocking the flow of fracturing fluid 31 to wells 1, 2 and 4. Similarly, the above-described operational sequence may be applied to selectively direct fracturing fluid 31 out of the fluid outlet 74 to well 4—the "Well 4 Flow" operating position—via the valve 10D while blocking the flow of fracturing fluid 31 to wells 1-3.

As noted above, the sliding sleeve valves 10 discussed above in connection with FIGS. 1-9 have a single sliding sleeve 84, while the sliding sleeve valves 10 discussed above in connection with FIGS. 10-18 have dual sliding sleeves, i.e., a single primary sliding sleeve 107 and single secondary sliding sleeve 109. However, with benefit of the present disclosure, those skilled in the art will appreciate that the single sliding sleeve and the dual sliding sleeve embodiment may be substituted for one another in many applications with only slight modifications to the equipment in which such a valve or valves are positioned. That is, the various components and configurations of the illustrative sliding sleeve valves 10 disclosed herein—both the single sliding sleeve embodiment and the dual sliding sleeve embodiment—may be essentially combined as desired based upon the particular application.

As will be appreciated by those skilled in the art, the unique valves 10 disclosed herein with the unique sliding sleeve elements disclosed herein—either the single sliding sleeve embodiment or the dual sliding sleeve embodiment—may be employed in various illustrative systems such as, for example, systems for fracturing oil and gas wells. However, the presently disclosed valves should not be considered to be limited to any particular application as the diverter valves disclosed herein may be used to selectively direct any type of fluid to one of a plurality of final destinations or targets. For example, the fluid 31 may comprise one or more chemicals and the diverter valves disclosed herein may be used to selectively direct such chemical-containing fluids to the wells 1-4 as described above. In another application, the fluid 31 may be water that may be selectively injected in the wells 1-4 using the diverter valves disclosed above. In another application, the diverter valves disclosed herein may be employed to selectively direct any type of fluid to one of a plurality of trucks or ships to be loaded with the fluid, or such fluid may be selectively directed to one or more holding ponds or tanks. The diverter valves disclosed herein may be employed with other fluids as well, e.g., crude oil, natural gas, hydrogen, other slurries, corn oil, etc. Additional applications and uses for the diverter valves disclosed herein will be apparent to those skilled in the art after a complete reading of the present application.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed:

1. A method, comprising:

receiving fluids into a primary flow path within a body of a diverter valve via one or more pumps;

axially shifting one or more sliding sleeve elements within the body to direct the fluids into one or more fluid flow galleries in the body;

axially shifting one or more pistons positioned in the body from a first piston position to a second piston position, and vice-versa, wherein when in the first piston position, at least one opening of the one or more pistons is not aligned with the one or more fluid flow galleries, and wherein when in the second piston position, the at least one opening is aligned with the one or more fluid flow galleries;

directing the fluids from the one or more fluid flow galleries to one or more fluid outlets in the body; and pumping the fluids into one or more flow conduits in fluid communication with a corresponding well, wherein each flow conduit of the one or more flow conduits is in dedicated fluid communication with a corresponding fluid outlet of the one or more fluid outlets.

2. The method of claim 1, wherein axially shifting the one or more sliding sleeve elements comprises moving the one or more sliding sleeve elements from a first closed position to a second open position, and vice-versa, wherein, in the first closed position, the one or more sliding sleeve elements blocks fluid flow between an internal flow bore of the one or more sliding sleeve elements and the one or more fluid flow galleries and wherein, in the second open position, the one or more sliding sleeve elements does not block fluid flow between the internal flow bore and the one or more fluid flow galleries.

3. The method of claim 2, further comprising supplying the fluids into one or more hydraulic chambers positioned in the body, wherein when supplied with the fluids, the one or more hydraulic chambers supplies hydraulic pressure to the one or more sliding sleeve elements to move from the first closed position to the second open position, and vice-versa.

4. The method of claim 2, further comprising, in the second open position, abutting and engaging an internal surface of the body with an end surface of the one or more sliding sleeve elements.

5. The method of claim 1, further comprising supplying the fluids into one or more hydraulic chambers positioned in the body, wherein when supplied with the fluids, the one or more hydraulic chambers supplies hydraulic pressure to the one or more pistons to move from the first piston position to the second piston position, and vice-versa.

6. The method of claim 1, further comprising:

engaging an external shoulder of the one or more sliding sleeve elements with an internal shoulder of the one or more pistons;

transferring actuating forces between the one or more sliding sleeve elements and the one or more pistons; and facilitating a movement of the one or more sliding sleeve elements and the one or more pistons.

7. The method of claim 6, further comprising positioning a seal at an interface between the one or more sliding sleeve elements and the one or more pistons.

8. The method of claim 1, wherein receiving fluids into the primary flow path comprises pumping the fluids from the one or more pumps into one or more fluid inlets provided at axial ends of the body and in fluid communication with the primary flow path.

9. The method of claim 1, further comprising selectively directing the fluids to a second fluid conduit via a second corresponding fluid outlet of the one or more fluid outlets.

* * * * *